US009972253B2

(12) United States Patent
Gotoh et al.

(10) Patent No.: US 9,972,253 B2
(45) Date of Patent: May 15, 2018

(54) ILLUMINATION APPARATUS, ILLUMINATION CONTROL METHOD, AND DISPLAY APPARATUS

(71) Applicant: Japan Display Inc., Tokyo (JP)

(72) Inventors: Fumitaka Gotoh, Tokyo (JP); Tsutomu Harada, Tokyo (JP); Toshiyuki Nagatsuma, Tokyo (JP); Akira Sakaigawa, Tokyo (JP); Masaaki Kabe, Tokyo (JP); Tae Kurokawa, Tokyo (JP); Kojiro Ikeda, Tokyo (JP)

(73) Assignee: Japan Display Inc., Tokyo (JP)

( * ) Notice: Subject to any disclaimer, the term of this patent is extended or adjusted under 35 U.S.C. 154(b) by 562 days.

(21) Appl. No.: 14/682,520

(22) Filed: Apr. 9, 2015

(65) Prior Publication Data

US 2015/0310828 A1 Oct. 29, 2015

(30) Foreign Application Priority Data

Apr. 24, 2014 (JP) ..... 2014-090316

(51) Int. Cl.
*G09G 3/36* (2006.01)
*G09G 3/34* (2006.01)

(52) U.S. Cl.
CPC ..... *G09G 3/3406* (2013.01); *G09G 2320/064* (2013.01); *G09G 2320/0646* (2013.01)

(58) Field of Classification Search
CPC ..... G09G 3/3406; G09G 2320/064; G09G 2320/0646; G09G 5/10; G09G 5/18; G09G 2330/021
USPC ..... 345/102, 205
See application file for complete search history.

(56) References Cited

U.S. PATENT DOCUMENTS

2007/0296689 A1 12/2007 Kimura et al.
2009/0284545 A1 11/2009 Watanabe et al.
2009/0315921 A1 12/2009 Sakaigawa et al.
2011/0037748 A1* 2/2011 Kang ..... G09G 3/3426 345/211

FOREIGN PATENT DOCUMENTS

JP 2007-322881 A 12/2007
JP 2010-002876 A 1/2010
JP 5568074 B2 8/2014

* cited by examiner

*Primary Examiner* — Amr Awad
*Assistant Examiner* — Aaron Midkiff
(74) *Attorney, Agent, or Firm* — Michael Best & Friedrich LLP

(57) ABSTRACT

Provided are a display apparatus and an illumination apparatus including: a light source; a time division control unit that performs a time division operation on a value represented by a first luminance control signal of a first bit number for controlling luminance of the light source to generate second luminance control signals each having a second bit number that is smaller than the first bit number and generates third luminance control signals each having a pulse width that corresponds to one of the values represented by the second luminance control signals; and a drive unit that generates drive signals for causing the light source to emit light on the basis of the third luminance control signals and supplies the drive signals to the light source.

7 Claims, 25 Drawing Sheets

T1

| BLPWM[1:0] | VALUES OF CHANGE OF BLPWM[9:2] | | | | FRAC-TIONAL PART |
|---|---|---|---|---|---|
| | n | n+1 | n+2 | n+3 | |
| 0 | 0 | 0 | 0 | 0 | 0.00 |
| 1 | 0 | 0 | 0 | +1 | 0.25 |
| 2 | 0 | +1 | 0 | +1 | 0.50 |
| 3 | 0 | +1 | +1 | +1 | 0.75 |

FIG. 9

T1-1

| BLPWM[1:0] | VALUES OF CHANGE OF BLPWM [9:2] | | | | FRAC-TIONAL PART |
|---|---|---|---|---|---|
| | n | n+1 | n+2 | n+3 | |
| 0 | 0 | 0 | 0 | 0 | 0.00 |
| 1 | +1 | 0 | 0 | 0 | 0.25 |
| 2 | +1 | 0 | +1 | 0 | 0.50 |
| 3 | +1 | +1 | +1 | 0 | 0.75 |

FIG. 12

T1-2

| BLPWM[1:0] | VALUES OF CHANGE OF BLPWM [9:2] | | | | FRAC-TIONAL PART |
|---|---|---|---|---|---|
| | n | n+1 | n+2 | n+3 | |
| 0 | 0 | 0 | 0 | 0 | 0.00 |
| 1 | +1 | 0 | 0 | 0 | 0.25 |
| 2 | +1 | 0 | +1 | 0 | 0.50 |
| 3 | +2 | 0 | +1 | 0 | 0.75 |

FIG. 14

T1-3

| BLPWM[1:0] | VALUES OF CHANGE OF BLPWM [9:2] | | | | FRAC-TIONAL PART |
|---|---|---|---|---|---|
| | n | n+1 | n+2 | n+3 | |
| 0 | 0 | 0 | 0 | 0 | 0.00 |
| 1 | +1 | 0 | +1 | -1 | 0.25 |
| 2 | +1 | 0 | +1 | 0 | 0.50 |
| 3 | +2 | 0 | +1 | 0 | 0.75 |

FIG. 16

T2

| BLPWM[3:0] | VALUES OF CHANGE OF BLPWM [11:4] | | | | | | | | | | | | | | | | FRAC-TIONAL PART |
|---|---|---|---|---|---|---|---|---|---|---|---|---|---|---|---|---|---|
| | n | n+1 | n+2 | n+3 | n+4 | n+5 | n+6 | n+7 | n+8 | n+9 | n+10 | n+11 | n+12 | n+13 | n+14 | n+15 | |
| 0 | 0 | 0 | 0 | 0 | 0 | 0 | 0 | 0 | 0 | 0 | 0 | 0 | 0 | 0 | 0 | 0 | 0.0000 |
| 1 | 0 | 0 | 0 | 0 | 0 | 0 | 0 | 0 | 0 | 0 | 0 | 0 | 0 | 0 | 0 | +1 | 0.0625 |
| 2 | 0 | 0 | 0 | 0 | 0 | 0 | 0 | +1 | 0 | 0 | 0 | 0 | 0 | 0 | 0 | +1 | 0.1250 |
| 3 | 0 | 0 | 0 | 0 | 0 | +1 | 0 | 0 | 0 | 0 | +1 | 0 | 0 | 0 | 0 | +1 | 0.1875 |
| 4 | 0 | 0 | 0 | +1 | 0 | 0 | 0 | +1 | 0 | 0 | 0 | +1 | 0 | 0 | 0 | +1 | 0.2500 |
| 5 | 0 | 0 | 0 | +1 | 0 | 0 | +1 | 0 | 0 | +1 | 0 | 0 | +1 | 0 | 0 | +1 | 0.3125 |
| 6 | 0 | 0 | +1 | 0 | 0 | +1 | 0 | +1 | 0 | 0 | +1 | 0 | 0 | +1 | 0 | +1 | 0.3750 |
| 7 | 0 | 0 | +1 | 0 | +1 | 0 | +1 | 0 | 0 | +1 | 0 | +1 | 0 | +1 | 0 | +1 | 0.4375 |
| 8 | 0 | +1 | 0 | +1 | 0 | +1 | 0 | +1 | 0 | +1 | 0 | +1 | 0 | +1 | 0 | +1 | 0.500 |
| 9 | 0 | +1 | 0 | +1 | 0 | +1 | 0 | +1 | +1 | 0 | +1 | 0 | +1 | 0 | +1 | +1 | 0.5625 |
| 10 | 0 | +1 | 0 | +1 | +1 | 0 | +1 | +1 | 0 | +1 | 0 | +1 | +1 | 0 | +1 | +1 | 0.6250 |
| 11 | 0 | +1 | +1 | 0 | +1 | +1 | 0 | +1 | +1 | 0 | +1 | +1 | 0 | +1 | +1 | +1 | 0.6875 |
| 12 | 0 | +1 | +1 | +1 | 0 | +1 | +1 | +1 | 0 | +1 | +1 | +1 | 0 | +1 | +1 | +1 | 0.7500 |
| 13 | 0 | +1 | +1 | +1 | +1 | +1 | 0 | +1 | +1 | +1 | +1 | 0 | +1 | +1 | +1 | +1 | 0.8125 |
| 14 | 0 | +1 | +1 | +1 | +1 | +1 | +1 | +1 | 0 | +1 | +1 | +1 | +1 | +1 | +1 | +1 | 0.8750 |
| 15 | 0 | +1 | +1 | +1 | +1 | +1 | +1 | +1 | +1 | +1 | +1 | +1 | +1 | +1 | +1 | +1 | 0.9375 |

FIG. 18

T2-1

| BLPWM[3:0] | VALUES OF CHANGE OF BLPWM [11:4] | | | | | | | | | | | | | | | | FRAC-TIONAL PART |
|---|---|---|---|---|---|---|---|---|---|---|---|---|---|---|---|---|---|
| | n | n+1 | n+2 | n+3 | n+4 | n+5 | n+6 | n+7 | n+8 | n+9 | n+10 | n+11 | n+12 | n+13 | n+14 | n+15 | |
| 0 | 0 | 0 | 0 | 0 | 0 | 0 | 0 | 0 | 0 | 0 | 0 | 0 | 0 | 0 | 0 | 0 | 0.0000 |
| 1 | 0 | 0 | 0 | 0 | 0 | 0 | 0 | 0 | 0 | 0 | 0 | 0 | 0 | 0 | 0 | +1 | 0.0625 |
| 2 | 0 | 0 | 0 | 0 | 0 | 0 | 0 | +1 | 0 | 0 | 0 | 0 | 0 | 0 | 0 | +1 | 0.1250 |
| 3 | 0 | 0 | 0 | 0 | 0 | +1 | 0 | 0 | 0 | 0 | +1 | 0 | 0 | 0 | 0 | +1 | 0.1875 |
| 4 | 0 | 0 | 0 | +1 | 0 | 0 | 0 | +1 | 0 | 0 | 0 | +1 | 0 | 0 | 0 | +1 | 0.2500 |
| 5 | 0 | 0 | 0 | +1 | 0 | 0 | +1 | 0 | 0 | +1 | 0 | 0 | +1 | 0 | 0 | +1 | 0.3125 |
| 6 | 0 | 0 | +1 | 0 | 0 | +1 | 0 | +1 | 0 | 0 | +1 | 0 | 0 | +1 | 0 | +1 | 0.3750 |
| 7 | 0 | 0 | +1 | 0 | +1 | 0 | +1 | 0 | 0 | +1 | 0 | +1 | 0 | +1 | 0 | +1 | 0.4375 |
| 8 | 0 | +1 | 0 | +1 | 0 | +1 | 0 | +1 | 0 | +1 | 0 | +1 | 0 | +1 | 0 | +1 | 0.500 |
| 9 | 0 | +1 | 0 | +1 | 0 | +1 | 0 | +1 | +1 | 0 | +1 | 0 | +1 | 0 | +1 | +1 | 0.5625 |
| 10 | 0 | +1 | 0 | +1 | +1 | 0 | +1 | +1 | 0 | +1 | 0 | +1 | +1 | 0 | +1 | +1 | 0.6250 |
| 11 | 0 | +1 | +1 | 0 | +1 | +1 | 0 | +1 | +1 | 0 | +1 | +1 | 0 | +2 | 0 | +1 | 0.6875 |
| 12 | 0 | +2 | 0 | +1 | 0 | +2 | 0 | +1 | 0 | +2 | 0 | +1 | 0 | +2 | 0 | +1 | 0.7500 |
| 13 | 0 | +2 | 0 | +2 | 0 | +1 | 0 | +2 | 0 | +2 | 0 | 0 | +1 | +2 | 0 | +1 | 0.8125 |
| 14 | 0 | +2 | 0 | +2 | 0 | +2 | 0 | +1 | 0 | +2 | 0 | +2 | 0 | +2 | 0 | +1 | 0.8750 |
| 15 | 0 | +2 | 0 | +2 | 0 | +2 | 0 | +2 | 0 | +2 | 0 | +2 | 0 | +2 | 0 | +1 | 0.9375 |

FIG. 20

ILLUMINATION APPARATUS, ILLUMINATION CONTROL METHOD, AND DISPLAY APPARATUS

CROSS-REFERENCE TO RELATED APPLICATION

This application is based upon and claims the benefit of priority of the prior Japanese Patent Application No. 2014-090316, filed on Apr. 24, 2014, the entire contents of which are incorporated herein by reference.

FIELD

The embodiments discussed herein relate to an illumination apparatus, an illumination control method, and a display apparatus.

BACKGROUND

Recent years have seen a development of liquid crystal panel display apparatuses that adopt an RGBW display method. While a pixel is conventionally formed by three sub-pixels red (R), green (G), and blue (B), a pixel according to the RGBW display method is formed by four sub-pixels red (R), green (G), blue (B), and white (W). In this way, it is possible to decrease the luminance of a backlight that illuminates a liquid crystal panel from behind or the like by the amount of improvement of the luminance of each sub-pixel W. As a result, it is possible to reduce the overall power consumption of the display apparatus.

However, such display method could deteriorate the image quality, depending on control of the luminance of the backlight. Thus, techniques for solving this problem have been proposed. One technique uses a conversion table including luminance setting values that are set to achieve luminance suitable for an image signal. The luminance setting values are converted into backlight control values, which are supplied to the backlight.

According to another technique, an adjustment value for adjusting the backlight luminance is calculated from an average image luminance per screen and a luminance adjustment line. The backlight luminance is controlled by generating a signal for driving the backlight on the basis of the adjustment value. For the background art, see, for example, the following documents:

Japanese Laid-open Patent Publication No. 2007-322881
Japanese Laid-open Patent Publication No. 2010-002876

SUMMARY

According to one aspect, there are provided an illumination apparatus, an illumination control method, and a display apparatus that prevent the deterioration of image quality. According to another aspect, there are provided an illumination apparatus, an illumination control method, and a display apparatus that realize accurate luminance control.

In one aspect of the embodiments, there is provided an illumination apparatus including: a light source; a time division control unit configured to perform a time division operation on a value represented by a first luminance control signal of a first bit number for controlling luminance of the light source to generate second luminance control signals each having a second bit number that is smaller than the first bit number and generate third luminance control signals each having a pulse width that corresponds to one of the values represented by the second luminance control signals; and a drive unit configured to generate drive signals for causing the light source to emit light on the basis of the third luminance control signals and supplies the drive signals to the light source.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 9 is an exemplary table illustrating values of change of time-divided BLPWM signals [9:2];

FIG. 12 is another exemplary table illustrating values of change of time-divided BLPWM signals [9:2];

FIG. 14 is another exemplary table illustrating values of change of time-divided BLPWM signals [9:2];

FIG. 16 is another exemplary table illustrating values of change of time-divided BLPWM signals [9:2];

FIG. 18 is an exemplary table illustrating values of change of time-divided BLPWM signals [11:4];

FIG. 20 is another exemplary table illustrating values of change of time-divided BLPWM signals [11:4];

DESCRIPTION OF EMBODIMENTS

Figure 1:
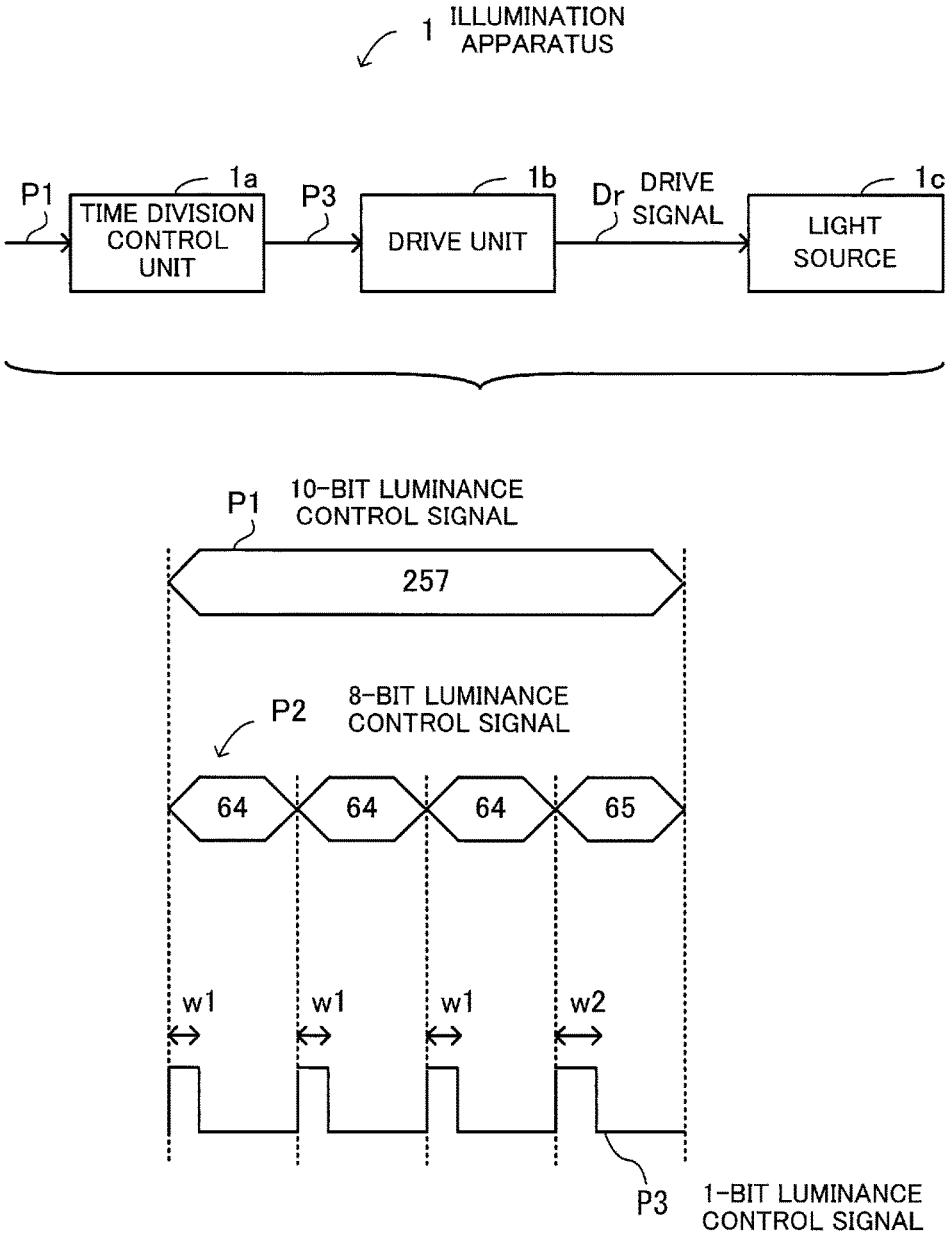
FIG. 1 illustrates an exemplary configuration of an illumination apparatus.

Several embodiments will be described below with reference to the accompanying drawings.

The following embodiments discussed are merely examples. Variations that could readily be made as needed by those skilled in the art within the gist of the present invention are of course included in the scope of the present invention. In addition, while there are cases in which the width, thickness, shape, etc. of each element are illustrated more schematically than in reality in the drawings for the clarity of description, the drawings are provided only to illustrate examples, not to limit the interpretation of the present invention.

In addition, like reference characters refer to like elements throughout the drawings, and redundant detailed description will be omitted as needed.

First, an embodiment will briefly be described with reference to FIG. 1. FIG. 1 illustrates an exemplary configuration of an illumination apparatus 1. The illumination apparatus 1 includes a time division control unit 1*a*, a drive unit 1*b*, and an illumination light source 1*c* used for a display panel or the like.

The time division control unit 1*a* performs a time division operation on a value represented by a luminance control signal P1 (a first luminance control signal) of a first bit number for controlling the luminance of the light source 1*c* to generate luminance control signals P2 (second luminance control signals) each having a second bit number that is smaller than the first bit number.

In addition, the time division control unit 1*a* generates luminance control signals P3 (third luminance control signals) each having a pulse width that corresponds to one of the values represented by the luminance control signals P2 generated by the time division operation.

The drive unit 1*b* generates drive signals Dr for causing the light source 1*c* to emit light on the basis of the luminance control signals P3 and supplies the drive signals Dr to the light source 1*c*.

Assuming that the first and second bit numbers are 10 and 8, respectively, in the exemplary time-division control illustrated in FIG. 1, the time division control unit 1*a* performs a time division operation on a value of 257 represented by the 10-bit luminance control signal P1 to generate four 8-bit luminance control signals P2, namely, values of 64, 64, 64, and 65.

In addition, the time division control unit 1*a* generates 1-bit luminance control signals P3 each having (the length of) a pulse width of w1 for each luminance control signal P2 representing a value of 64 and a 1-bit luminance control signal P3 having (the length of) a pulse width of w2 (>w1) for the luminance control signal P2 representing a value of 65.

In this way, the illumination apparatus 1 performs a time division operation on a value represented by the luminance control signal P1 of the first bit number to generate the luminance control signals P2 each having the second bit number that is smaller than the first bit number. In addition, the illumination apparatus 1 generates luminance control signals P3 each having a pulse width that corresponds to one of the values represented by the luminance control signals P2.

Next, the illumination apparatus 1 generates the drive signals Dr for causing the light source 1*c* to emit light on the basis of the luminance control signals P3 and supplies the drive signals Dr to the light source 1*c*.

With such control, the deterioration of the image quality is prevented, and accurate luminance control on the backlight is realized.

Before specific embodiments are described in detail, problems to be solved will be described with reference to FIGS. 2 to 7. An illumination apparatus having a backlight that illuminates a liquid crystal panel from behind or the like changes the luminance of the backlight on the basis of an image displayed. The luminance of the backlight is controlled by a pulse width modulated (PWM) signal.

When controlling the luminance of the backlight (PWM control), parallel bit PWM signals are conventionally converted into a 1-bit PWM signal, and drive control of a backlight (BL) driver is performed on the basis of the 1-bit PWM signal.

Hereinafter, parallel bit PWM signals will be referred to as backlight PWM (BLPWM) signals, and a 1-bit PWM signal will simply be referred to as a PWM signal, as needed.

When finely controlling the luminance of a backlight, the resolution of a PWM signal needs to be set finely by increasing the bit number of the parallel BLPWM signals. However, if the bit number of the BLPWM signals is simply increased, the following problems are caused:

(1) In a circuit that converts a multiple bit BLPWM signal into a 1-bit PWM signal, the period of the PWM signal is extended. As a result, flickering of the backlight could be caused.

(2) Contrastingly, if the period of the PWM signal is maintained, the pulse width of each 1-bit PWM signal is narrowed. As a result, since the BL driver cannot respond to the signal having the narrowed pulse width, the linearity of the luminance cannot be maintained.

Figure 2:
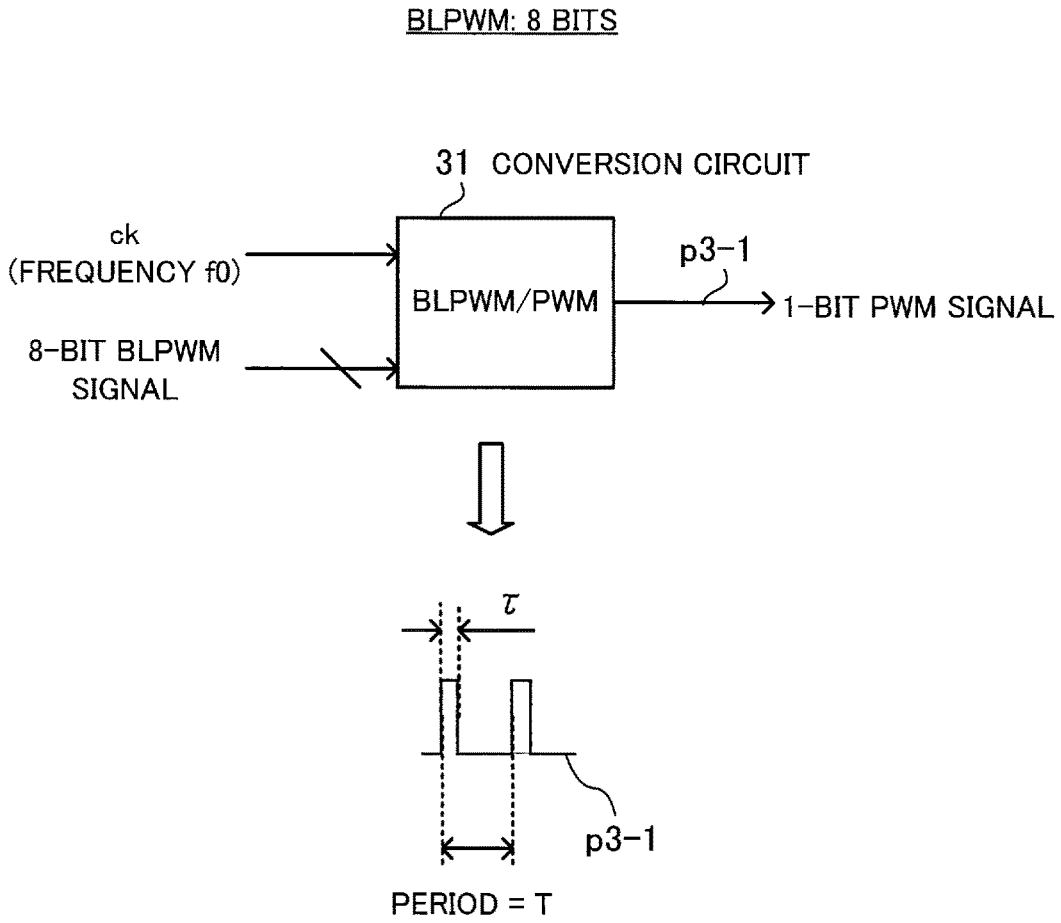
FIGS. 2 to 4 illustrate extension of the period of a pulse width modulated (PWM) signal.
Figure 3:
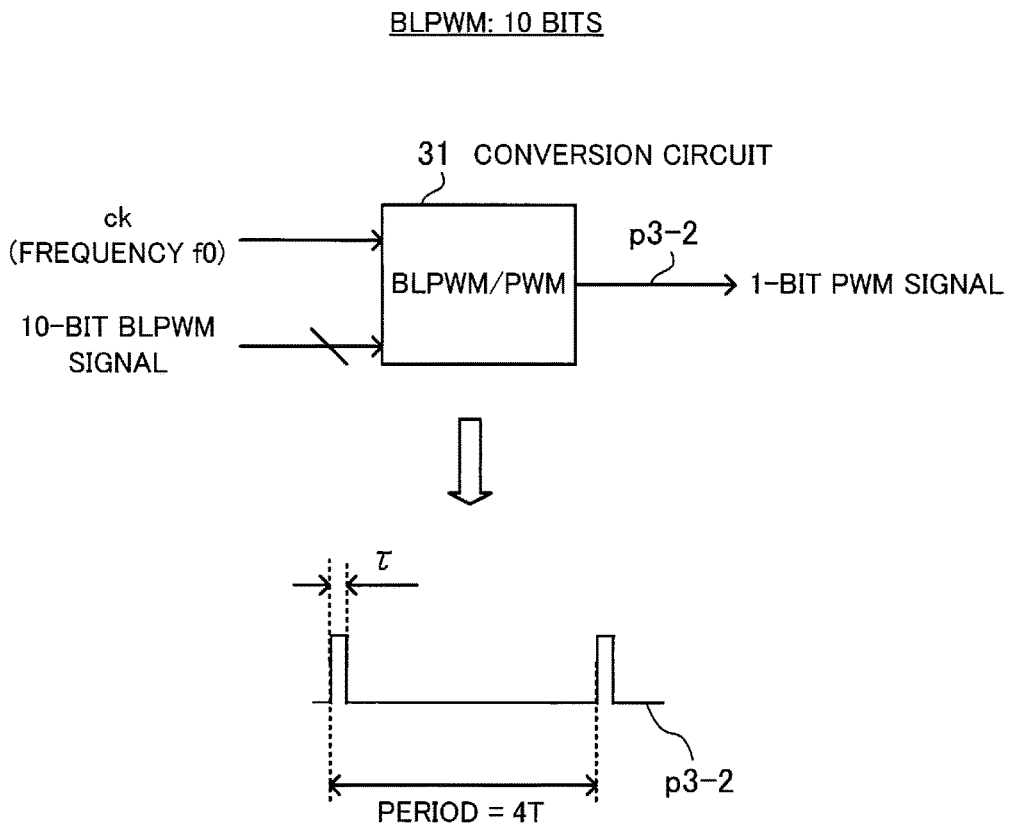
Figure 4:
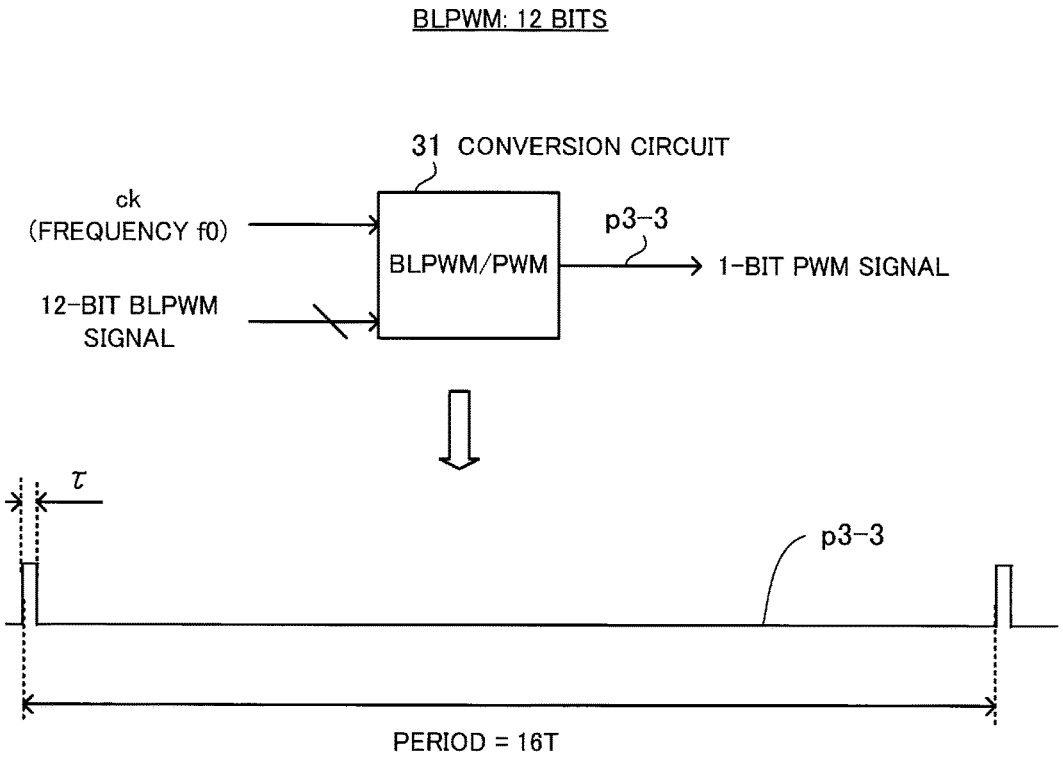

Hereinafter, problems (1) and (2) will be described in more detail with reference FIGS. 2 to 4 and FIGS. 5 to 7, respectively. FIGS. 2 to 4 illustrate extension of the period of a PWM signal.

FIG. 2 illustrates conversion of an 8-bit BLPWM signal into a PWM signal. A conversion circuit 31 receives a clock signal ck having a frequency of f0 and an 8-bit BLPWM signal and outputs a 1-bit PWM signal p3-1. In FIG. 2, one period of the PWM signal p3-1 is T and the high (H) level pulse width of the PWM signal p3-1 is $\tau$.

FIG. 3 illustrates conversion of a 10-bit BLPWM signal into a PWM signal. The conversion circuit 31 receives the clock signal ck having a frequency of f0 and a 10-bit BLPWM signal and outputs a 1-bit PWM signal p3-2.

If the H-level pulse width of the PWM signal p3-2 is set to $\tau$, which is the same as the H-level pulse width of the PWM signal p3-1 in FIG. 2, one period of the PWM signal p3-2 is extended to 4T.

FIG. 4 illustrates conversion of a 12-bit BLPWM signal into a PWM signal. The conversion circuit 31 receives the clock signal ck having a frequency of f0 and a 12-bit BLPWM signal and outputs a 1-bit PWM signal p3-3.

If the H-level pulse width of the PWM signal p3-3 is set to $\tau$, which is the same as the H-level pulse width of the PWM signal p3-1 in FIG. 2, one period of the PWM signal p3-3 is extended to 16T.

The clock number of the clock signal ck needed for generating a PWM signal from a BLPWM signal differs depending on the bit number of the BLPWM signal.

For example, 256 ($=2^8$) clocks are needed for generating a 1-bit PWM signal from an 8-bit BLPWM signal. In addition, 1024 ($=2^{10}$) clocks are needed for generating a 1-bit PWM signal from a 10-bit BLPWM signal. In addition, 4096 ($=2^{12}$) clocks are needed for generating a 1-bit PWM signal from a 12-bit BLPWM signal.

In contrast, as in the conversion circuit 31, if the frequency (clock number) of the input clock signal is maintained, only the bit number of the BLPWM signal is changed, and the pulse width of the PWM signal output from the conversion circuit 31 is set to be the same as that of the PWM signal output when the conversion circuit 31 receives a BLPWM signal of a minimum bit number, the period of the PWM signal output from the conversion circuit 31 is extended as the bit number of the BLPWM signal increases.

Namely, as illustrated in FIGS. 2 to 4, while the conversion circuit 31 receives the clock signal ck having the same frequency f0, the bit number of the BLPWM signal is increased from 8 to 10 and 12. In addition, the pulse width of the PWM signal output when the conversion circuit 31 receives the 8-bit BLPWM signal is maintained even when the conversion circuit 31 receives the 10- or 12-bit BLPWM signal (while the H level is maintained in the above examples, the low (L) level may be maintained alternatively).

In this way, while one period of each PWM signal output from the conversion circuit 31 when 8-bit BLPWM signals are input thereto is T, one period of each PWM signal is extended to 4T when the conversion circuit 31 receives 10-bit BLPWM signals.

In addition, while one period of each PWM signal output from the conversion circuit 31 when 8-bit BLPWM signals are input thereto is T, one period of each PWM signal is extended to 16T when the conversion circuit 31 receives 12-bit BLPWM signals.

Thus, if the luminance of the backlight is finely controlled by simply increasing the bit number of the BLPWM signals, the period of each PWM signal is increased (the frequency of each PWM signal is decreased), which causes the backlight to flicker on the screen. As a result, the image quality is deteriorated.

Figure 5:
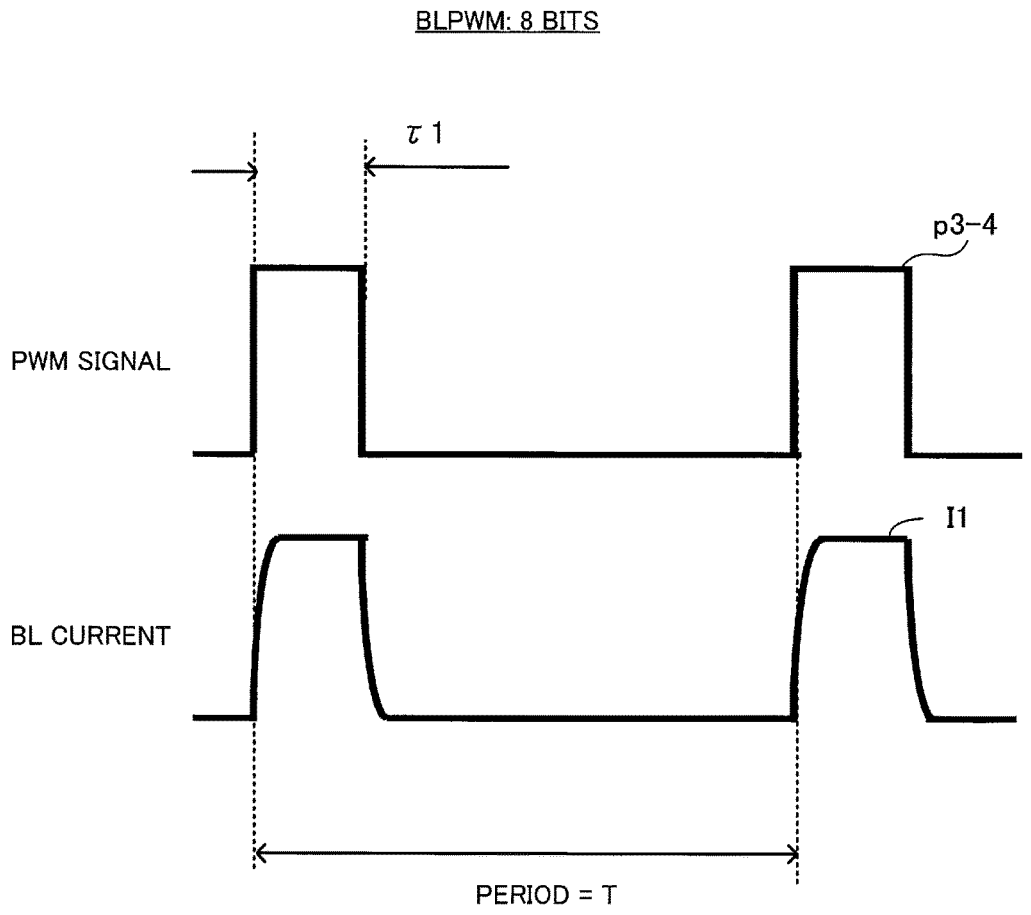
FIGS. 5 to 7 illustrate a phenomenon in which the pulse width of each 1-bit PWM signal is narrowed.
Figure 6:
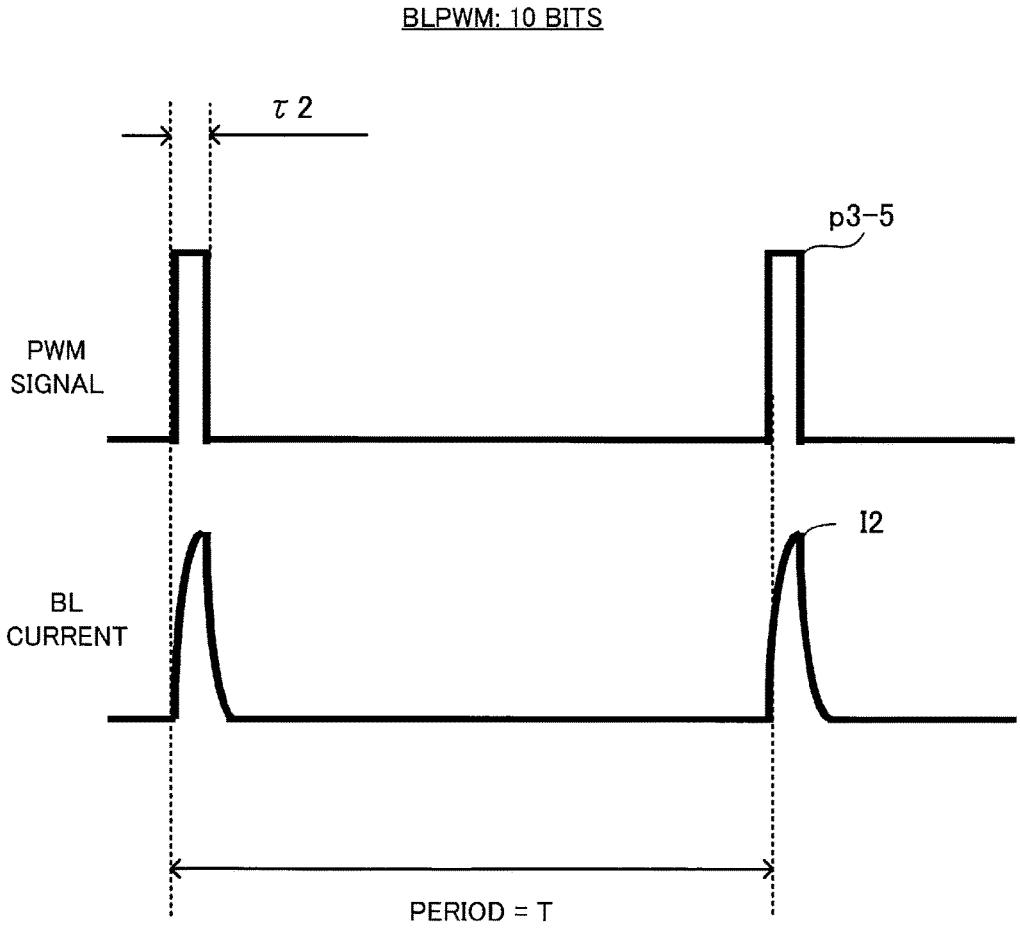
Figure 7:
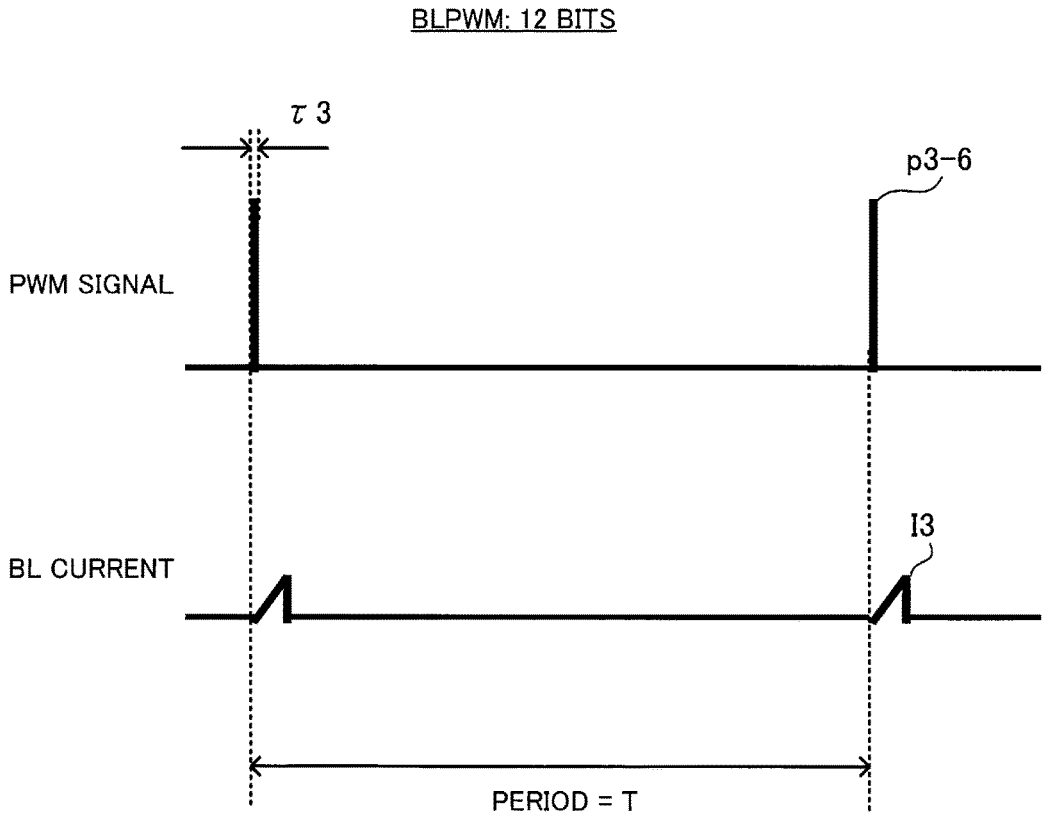

FIGS. 5 to 7 illustrate a phenomenon in which the pulse width of each 1-bit PWM signal is narrowed. If the parallel bit number of the BLPWM signals is increased while the period of each converted and output PWM signal is maintained, the pulse width of each PWM signal is narrowed. Hereinafter, why the pulse width of each PWM signal is narrowed will be described.

A "BL current" in FIGS. 5 to 7 is a current signal for setting the luminance of the backlight and is a drive signal generated by the BL driver on the basis of a PWM signal. In addition, the BL current is supplied to at least one light emitting diode (LED) constituting the backlight, and the luminance of the backlight is set on the basis of the value of the BL current.

FIG. 5 illustrates a waveform of a PWM signal p3-4 output after conversion of an 8-bit BLPWM signal and a waveform of a BL current I1 generated by the BL driver on the basis of the PWM signal p3-4.

It takes 1/256 time for a 1-bit PWM signal p3-4 generated from an 8-bit BLPWM signal to change, and the period of the PWM signal p3-4 is T.

If the H-level pulse width of the PWM signal p3-4 is $\tau 1$, the BL driver properly responds to the PWM signal p3-4 and generates the BL current I1 having a current value needed for setting the luminance of the backlight.

FIG. 6 illustrates a waveform of a PWM signal p3-5 output after conversion of a 10-bit BLPWM signal and a waveform of a BL current I2 generated by the BL driver on the basis of the PWM signal p3-5.

The PWM signal p3-5 generated from the 10-bit BLPWM signal has the same period T as that of the PWM signal p3-4 in FIG. 5. Since it takes 1/1024 time for the 1-bit PWM signal p3-5 to change, the pulse width of the PWM signal p3-5 is $\tau 2$ ($<\tau 1$), which is narrower than the pulse width $\tau 1$ of the PWM signal p3-4.

FIG. 7 illustrates a waveform of a PWM signal p3-6 output after conversion of a 12-bit BLPWM signal and a waveform of a BL current I3 generated by the BL driver on the basis of the PWM signal p3-6.

The PWM signal p3-6 generated from the 12-bit BLPWM signal also has the same period T as that of the PWM signal p3-4 in FIG. 5. Since it takes 1/4096 time for the 1-bit PWM signal p3-6 to change, the pulse width of the PWM signal p3-6 is $\tau 3$ ($<\tau 2<\tau 1$), which is narrower than the pulse widths $\tau 1$ and $\tau 2$ of the PWM signals p3-4 and p3-5, respectively.

The H-level pulse widths $\tau 2$ and $\tau 3$ of the PWM signals p3-5 and p3-6 illustrated in FIGS. 6 and 7, respectively, are less than a predetermined value to which the BL driver is able to respond.

In such cases, when the PWM signal p3-5 having a pulse width of $\tau 2$ is input to the BL driver, since the BL driver is unable to properly respond to the PWM signal p3-5, the BL driver is unable to generate a BL current needed for driving the backlight.

Likewise, when the PWM signal p3-6 having a pulse width of $\tau 3$ is input to the BL driver, the BL driver is unable to properly respond to the PWM signal p3-6. Thus, the BL driver is unable to generate a BL current needed for driving the backlight.

More specifically, if the pulse width of a PWM signal input to the BL driver falls below a predetermined value, when the BL current rises in response to a rising edge of the PWM signal, the PWM signal is decreased to the L level before the rising edge of the BL current is sufficiently ensured, and information represented by the PWM signal is not reflected on the amount of the BL current.

Thus, if the luminance of the backlight is finely controlled by increasing the bit number of the BLPWM signals, the pulse width of each 1-bit PWM signal is narrowed to be less than a predetermined value. If the pulse width of each PWM signal is narrowed, the BL driver is unable to properly respond to the PWM signal, and the linearity of the luminance is not maintained. If the linearity of the luminance is not maintained, the image quality is deteriorated as a result.

The present embodiment has been made in view of such circumstances. The present embodiment realizes accurate luminance control on the backlight and realizes illumination control while preventing the deterioration of the image quality.

Hereinafter, the illumination apparatus 1 according to the present embodiment will be described in detail. The time division control unit 1*a* of the illumination apparatus 1 does not change the resolution of each PWM signal even if the bit number of the BLPWM signals is increased. Instead, the time division control unit 1*a* changes the PWM signal temporally so as to represent the increase of the bit number of the BLPWM signals (Hereinafter, control performed by the time division control unit 1*a* will also be referred to as BLPWM time-division control).

Figure 8:
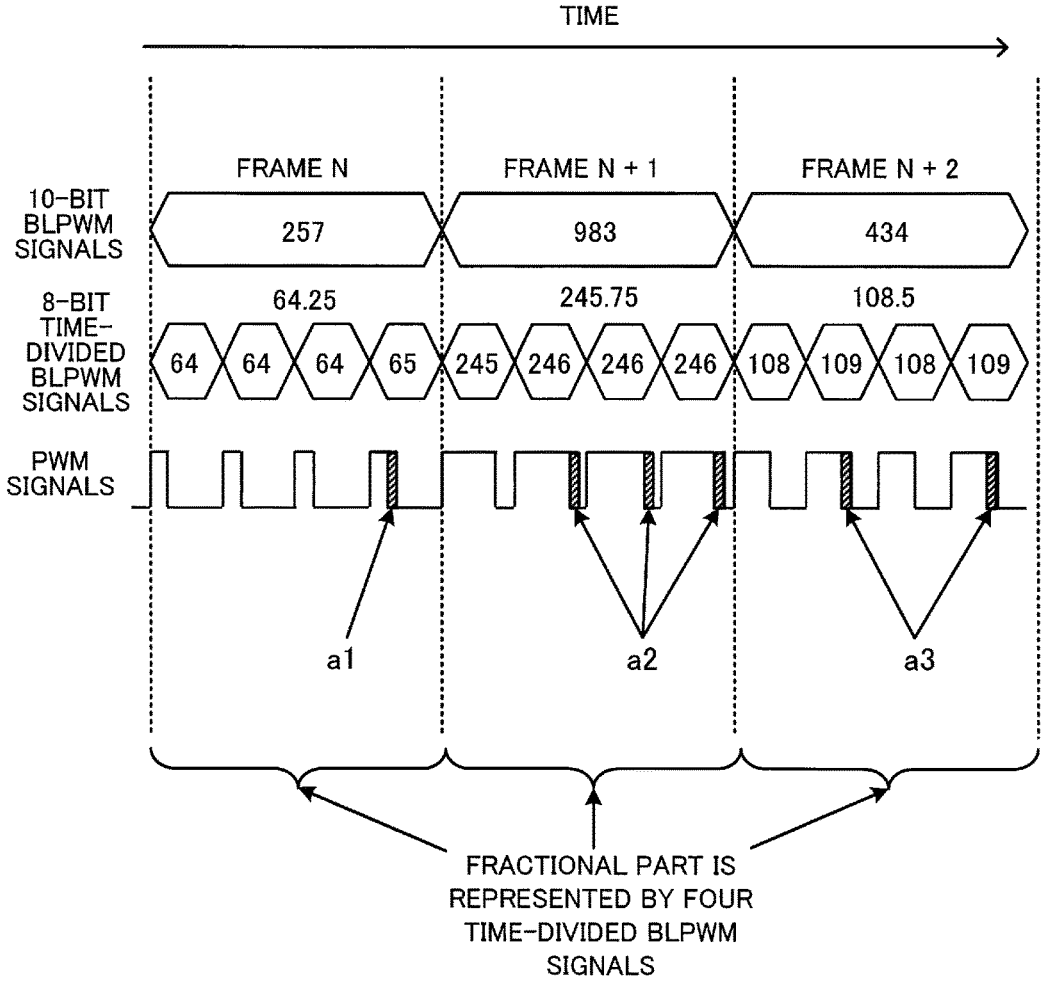
FIG. 8 illustrates a concept of backlight (BL) PWM time-division control.

FIG. 8 illustrates a concept of the BLPWM time-division control. Each BLPWM signal is a 10-bit parallel signal. Each "10-bit BLPWM signal" in FIG. 8 corresponds to a luminance control signal P1 in FIG. 1.

In addition, each "8-bit time-divided BLPWM" in FIG. 8 corresponds to a luminance control signal P2 in FIG. 1. In addition, each "PWM signal" in FIG. 8 corresponds to a luminance control signal P3 in FIG. 1.

In addition, values (luminance gradation values) represented by the 10-bit BLPWM signals in frames N, N+1, and N+2 are 257, 983, and 434, respectively.

Next an example in which the BLPWM time-division control is performed on the frames represented by 10-bit BLPWM signals will be examined. In this case, each 10-bit BLPWM signal is converted into 8-bit BLPWM signals, for example.

In this example, the lower 2 bits of the 10 bits are dropped, which corresponds to a division by $2^2$ in a bit shift operation. In the case of frame N, 257 is divided by $2^2$, and 64.25 (=257/4) is obtained. The result 64.25 includes an integer part of 64 represented by 8 bits and a fractional part of 0.25.

If such a fractional part is generated, the 10-bit BLPWM signal is represented by changing at least one of the integer parts of the 8-bit BLPWM signals. For example, a time division operation is performed on 257 represented by the 10-bit BLPWM signal in the time domain in frame N to generate four 8-bit BLPWM signals, which are 8-bit data representing 64, 64, 64, and 65, respectively.

In this example, the average value of the 8-bit BLPWM signals is 64.25 ((64+64+64+65)/4). The fractional part is represented by the four 8-bit time-divided BLPWM signals representing 64, 64, 64, and 65, respectively.

In addition, the time division control unit 1*a* generates 1-bit PWM signals each having a pulse width that corresponds to one of the values of 64 and 65. A shaded area a1 in FIG. 8 represents an increase of a 1-bit PWM signal, namely, the value of 65 obtained by adding 1 to 64.

While this 8-bit data value 65 is located as the fourth value from the top in the time domain in frame N in FIG. 8, the 8-bit data value 65 may be located anywhere in the time domain in frame N. However, for example, if the 8-bit data value 65 is set to be located as the fourth value in the time domain in frame N, the 8-bit data value 65 always needs to be located as the fourth value in the time domain in frame N when frames are switched.

Regarding frame N+1, 983 is divided by $2^2$, and 245.75 (=983/4) is obtained. The result 245.75 includes an integer part of 245 represented by 8 bits and a fractional part of 0.75.

Thus, a time division operation is performed on 983 represented by the 10-bit BLPWM signal in the time domain in frame N+1 to generate four 8-bit BLPWM signals, which are 8-bit data representing 245, 246, 246, and 246, respectively.

In this case, the average value of the 8-bit BLPWM signals is 245.75 ((245+246+246+246)/4. The fractional part is represented by the four 8-bit time-divided BLPWM signals representing 245, 246, 246, and 246, respectively.

In addition, the time division control unit 1*a* generates 1-bit PWM signals each having a pulse width that corresponds to one of the values 245 and 246. Each shaded area a2 in FIG. 8 represents an increase of a 1-bit PWM signal, namely, the value of 246 obtained by adding 1 to 245.

While the 8-bit data values 246 are located as the second to fourth values from the top in the time domain in frame N+1 in FIG. 8, the 8-bit data values 246 may be located anywhere in the time domain in frame N+1. However, it is preferable that these data values including the increase be allocated in a balanced manner in the frame, instead of being allocated otherwise. In addition, for example, if the 8-bit data values 246 are set to be located as the second to fourth values in the time domain in frame N+1, the 8-bit data values 246 always need to be located as the second to fourth values in the time domain in frame N+1 when frames are switched.

Regarding frame N+2, 434 is divided by $2^2$, and 108.5 (=434/4) is obtained. The result 108.5 includes an integer part of 108 represented by 8 bits and a fractional part of 0.5.

Thus, a time division operation is performed on 434 represented by the 10-bit BLPWM signal in the time domain in frame N+2 to generate four 8-bit BLPWM signals, which are 8-bit data representing 108, 109, 108, and 109, respectively.

In this case, the average value of the 8-bit BLPWM signals is 108.5 ((108+109+108+109)/4). The fractional part is represented by the four 8-bit time-divided BLPWM signals representing 108, 109, 108, and 109, respectively.

In addition, the time division control unit 1*a* generates 1-bit PWM signals each having a pulse width that corresponds to one of the values 108 and 109. Each shaded area a3 in FIG. 8 represents an increase of a 1-bit PWM signal, namely, the value of 109 obtained by adding 1 to 108.

While the 8-bit data values 109 are located as the second and fourth values from the top in the time domain in frame N+2 in FIG. 8, the 8-bit data values 109 may be located anywhere in the time domain in frame N+2. However, it is preferable that these data values including the increase be allocated in a balanced manner in the frame, instead of being allocated otherwise. In addition, for example, if the 8-bit data values 109 are set to be located as the second and fourth values in the time domain in frame N+2, the 8-bit data values 109 always need to be located as the second and fourth values in the time domain in frame N+2 when frames are switched.

As described above, when the parallel bit number of the BLPWM signal is K and the bit number of the time-divided BLPWM signals is L (<K), the time division control unit 1*a* of the illumination apparatus 1 divides a predetermined time domain of the BLPWM signal (divides the time domain in a single frame, for example) into $2^{K-L}$ segments. When K is 10 and L is 8, 4 ($=2^{10-8}$) segments are generated.

A luminance gradation value represented by the K-bit (10-bit) is divided by $2^{K-L}$ (for example, 257 is divided by $2^{10-8}$).

Next, integer values, each being represented by the L-bit, are allocated to the $2^{K-L}$ segments. In this case, integer values are assigned so that the average value obtained by dividing the sum of the values that are allocated to the $2^{K-L}$ segments by $2^{K-L}$ matches the result of the division. The fractional part is allocated to one of the segments. For example, since the result of the division of the sum of 64, 64, 64, and 65 by $2^{10-8}$ is $257/2^{10-8}$, 64, 64, 64, and 65 are allocated to the four segments, respectively.

In FIG. 8, the BLPWM time-division control is performed on each frame. For example, a time division operation is temporally performed on each 10-bit BLPWM signal to generate 8-bit data, and each of the 8-bit data of the time-divided BLPWM signals generated is converted into a 1-bit PWM signal.

In this way, accurate luminance control is performed. When a BLPWM signal is converted into a PWM signal, even if the parallel bit number of the BLPWM signal varies, one period of the PWM signal is maintained, and flickering of the luminance is prevented.

In addition, since it is possible to maintain the pulse width of each 1-bit PWM signal while maintaining one period of the PWM signal, the BL driver that corresponds to the drive unit 1*b* in FIG. 1 properly operates, and the linearity of the luminance is ensured.

Next, an example in which a 10-bit BLPWM signal is represented by 8-bit time-divided BLPWM signals will be described in more detail. Hereinafter, bits are denoted by [MSB:LSB]. MSB and LSB represent the most significant bit and the least significant bit, respectively.

For example, a signal A [9:0] signifies a signal in which the LSB is the 0th bit and the MSB is the 9th bit. Namely, the signal A [9:0] is a 10-bit signal composed of the 0th to 9th bits.

In addition, for example, a signal B [9:2] signifies a signal in which the LSB is the 2nd bit and the MSB is the 9th bit. Namely, the signal B [9:2] is an 8-bit signal composed of the 2nd to 9th bits.

In the following description, a 10-bit parallel BLPWM signal will be represented as a BLPWM signal [9:0] in accordance with the above bit representation. In addition, an 8-bit integer part represented by the 2nd to 9th bits of a BLPWM signal will be represented as a BLPWM signal [9:2].

In addition, a 2-bit fractional part represented by the 0th and 1st bits of a BLPWM signal will be represented as a BLPWM signal [1:0]. In addition, an 8-bit time-divided BLPWM signal will be represented as a time-divided BLPWM signal [9:2].

Regarding the two bits representing a fractional part, $0.00_{(10)}$ corresponds to $00_{(2)}$, $0.25_{(10)}$ to $01_{(2)}$, $0.5_{(10)}$ to $10_{(2)}$, and $0.75_{(10)}$ to $11_{(2)}$. Thus, a fractional part of 0.00 will be represented as a BLPWM signal [1:0]=0 ($00_{(2)}\rightarrow 0$).

In addition, a fractional part of 0.25 will be represented as a BLPWM signal [1:0]=1 ($01_{(2)}\rightarrow 1$). Likewise, a fractional part of 0.50 will be represented as a BLPWM signal [1:0]=2 ($10_{(2)}\rightarrow 2$) and a fractional part 0.75 as a BLPWM signal [1:0]=3 ($11_{(2)}\rightarrow 3$).

FIG. 9 is an exemplary table T1 illustrating values of change of time-divided BLPWM signals [9:2]. The table T1 includes columns for "BLPWM[1:0]," "Values of change of BLPWM[9:2]," and "Fractional part." The column for "Values of change of BLPWM[9:2]" is divided into four time domains n to n+3, which correspond to count values of a counter.

In addition, in a single frame, this counter performs cyclic counting (n→n+1→n+2→n+3→n→n+1→ and so on).

In the table T1, BLPWM[1:0]=0 represents a fractional part of 0.00, and all the count values n, n+1, n+2, and n+3 under the column "Values of change of BLPWM[9:2]" represent "0," which means that values represented by the 8-bit data composed of the 2nd to 9th bits of the time-divided BLPWM signals [9:2] are directly used.

For example, if a value represented by a BLPWM signal [9:0] is 256, since 256/4 is 64, no fractional part is included. Thus, each of the values in the time domains corresponding to the count values n, n+1, n+2, and n+3 in a single frame is represented by an 8-bit data integer of 64. Namely, in this example, all the count values n, n+1, n+2, and n+3 represent "0."

In addition, when BLPWM[1:0]=1, the fractional part represents 0.25. Thus, one of the count values n, n+1, n+2, and n+3 under the column "Values of change of BLPWM [9:2]" represents "+1," and the other three count values represent "0."

Note that "+1" signifies the fractional part represented by the 2-bit BLPWM signal [1:0] composed of the 0th and 1st bits.

For example, if a value represented by a BLPWM signal [9:0] is 257, since 257/4 is 64.25, a fractional part of 0.25 is included. Since the value 64.25 is represented by the average of 64, 64, 64, and 65 (=64+1), "0" is set in three of the four time domains to represent 64, and "+1" is set in the other one of the four time domains to represent 65.

In the example in FIG. 9, when BLPWM[1:0]=1, the table T1 is set so that three time domains corresponding to the count values n, n+1, and n+2 represent "0" and the other one time domain corresponding to the count value n+3 represents "1."

In addition, BLPWM[1:0]=2 represents a fractional part of 0.50. Thus, two of the count values n, n+1, n+2, and n+3 under the column "Values of change of BLPWM[9:2]" represent "+1" and the other two count values represent "0."

For example, when a value represented by a BLPWM signal [9:0] is 434, since 434/4 is 108.5, a fractional part of 0.5 is included. Since the value 108.5 is represented by the average of 108, 108, 109 (=108+1), and 109 (=108+1), "0" is set in two of the four time domains to represent 108 and "+1" is set in the other two time domains to represent 109.

In the example in FIG. 9, when BLPWM[1:0]=2, the table T1 is set so that two time domains corresponding to the count values n and n+2 represent "0" and the other two time domains corresponding to the count values n+1 and n+3 represent "+1."

In addition, BLPWM[1:0]=3 represents a fractional part of 0.75. Thus, three of the four count values n, n+1, n+2, and n+3 under the column "Values of change of BLPWM[9:2]" represent "+1" and the other one count value represents "0."

For example, when a value represented by a BLPWM signal [9:0] is 983, since 983/4 is 245.75, a fractional part of 0.75 is included. Since this value 245.75 is represented by the average of 245, 246 (=245+1), 246 (=245+1), and 246 (=245+1), "0" is set in one of the four time domains to represent 245, and "+1" is set in the other three time domains to represent 246.

In the example in FIG. 9, when BLPWM[1:0]=3, the table T1 is set so that one time domain corresponding to the count value n represents "0" and the other three time domains corresponding to the count values n+1, n+2, and n+3 represent "1." Other exemplary tables illustrating values of change of time-divided BLPWM signals [9:2] will be described below.

Figure 10:
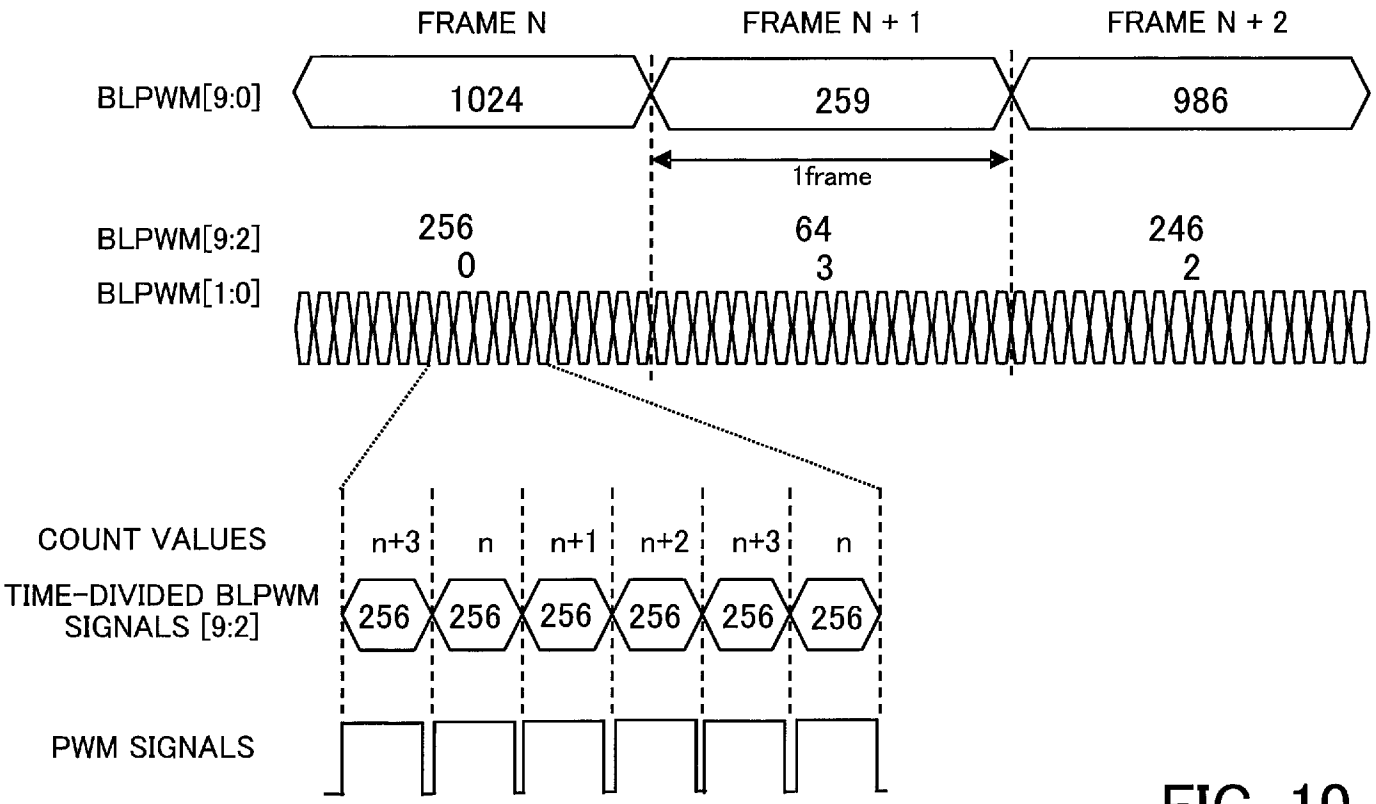
FIGS. 10 and 11 illustrate exemplary BLPWM time-division control.
Figure 11:
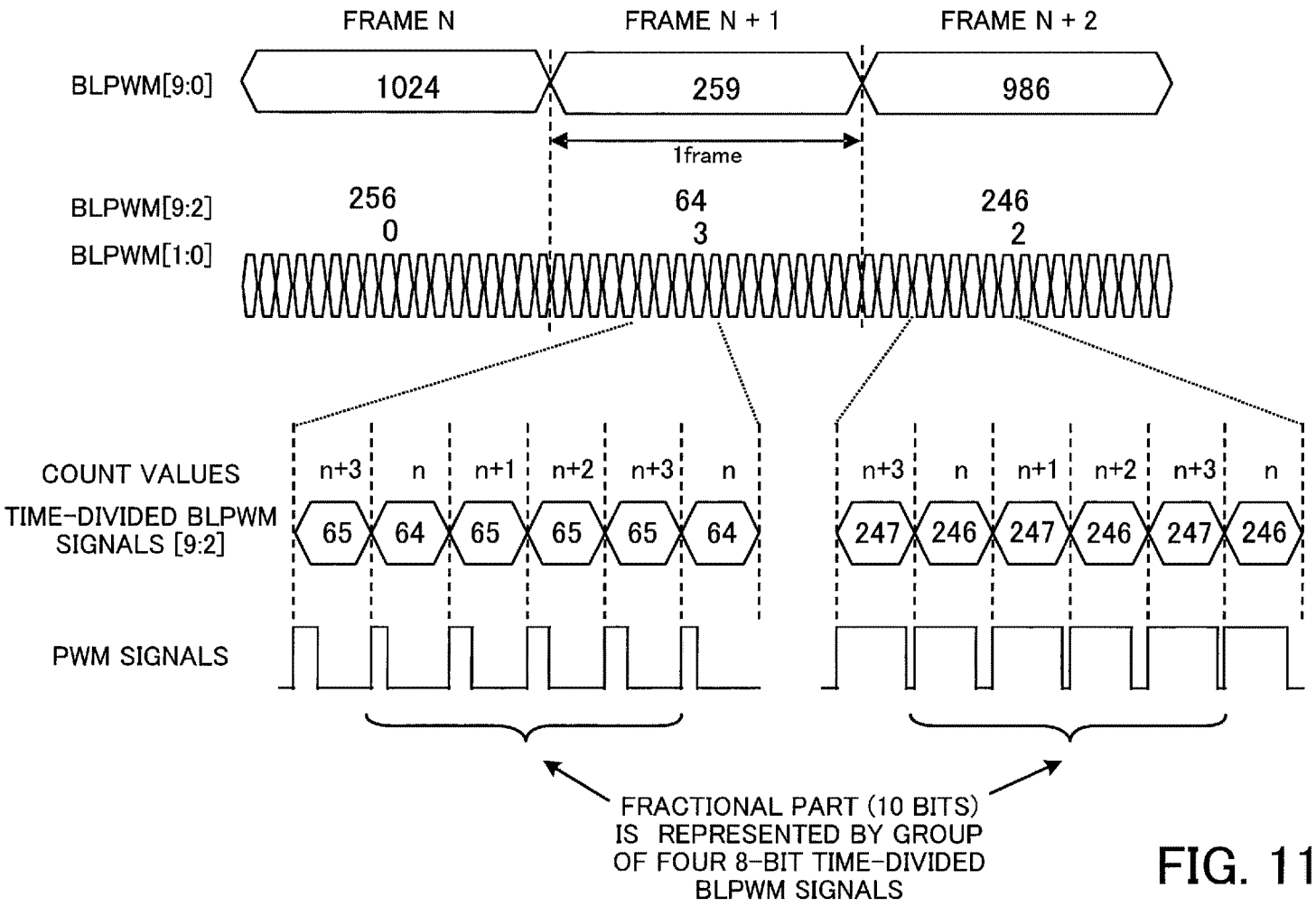

FIGS. 10 and 11 illustrate exemplary BLPWM time-division control. An example of BLPWM time-division control for converting a 10-bit BLPWM signal into 8-bit time-divided BLPWM signals will be described. In FIG. 10, values represented by the BLPWM signals [9:0] in frames N, N+1, and N+2 are 1024, 259, and 986, respectively.

In frame N, since the average is 256 (=1024/4), each time-divided BLPWM signal [9:2] represents 256, and the BLPWM signal [1:0] represents 0 (corresponding to a fractional part of 0.00).

In addition, in frame N+1, since the average is 64.75 (=259/4), at least one time-divided BLPWM signal [9:2] represents 64, and the BLPWM signal [1:0] represents 3 (corresponding to the fractional part of 0.75).

In addition, in frame N+2, since the average is 246.5 (=986/4), at least one time-divided BLPWM signal [9:2] represents 246, and the BLPWM signal [1:0] represents 2 (corresponding to the fractional part of 0.50).

Regarding the time-divided BLPWM signals [9:2] in FIG. 10, the BLPWM signal [1:0] represents 0 in frame N. Thus, the time domains corresponding to the count values n, n+1, n+2, and n+3 represent "0" in accordance with the table T1.

Namely, all of the time-divided BLPWM signals [9:2] in frame N represent 8-bit data 256 in the time domains corresponding to the count values n, n+1, n+2, and n+3. As a result, 1-bit PWM signals each having a pulse width corresponding to the value 256 are generated.

In FIG. 11, the BLPWM signal [1:0] represents 3 in frame N+1. Thus, the time domain corresponding to the count value n represents "0" and the time domains corresponding to the count values n+1, n+2, and n+3 represent "+1" in accordance with the table T1.

Namely, regarding the time-divided BLPWM signals [9:2] in frame N+1, the value in the time domain corresponding to the count value n represents 64 and the values in the time domains corresponding to the count values n+1, n+2, and n+3 represent 65. Next, 1-bit PWM signals each having a pulse width corresponding to one of the values 64 and 65 are generated.

In addition, in FIG. 11, the BLPWM signal [1:0] represents 2 in frame N+2. Thus, the time domains corresponding to the count values n and n+2 represent "0" and the time domains corresponding to the count values n+1 and n+3 represent "+1" in accordance with the table T1.

Namely, regarding the time-divided BLPWM signals [9:2] in frame N+2, the values in the time domains corresponding to the count values n and n+2 represent 246 and the values in the time domains corresponding to the count values n+1 and n+3 represent 247. Next, 1-bit PWM signals each having a pulse width corresponding to one of the values 246 and 247 are generated.

By performing the above BLPWM time-division control, a minimum pulse width of a PWM signal to which the BL driver is able to properly respond is maintained, and the period of the PWM signal is also maintained.

In the table T1 illustrated in FIG. 9, when the BLPWM signal [1:0] represents 1, the time domain corresponding to the count value n+3 represents "+1." In addition, when the BLPWM signal [1:0] represents 2, the time domains corresponding to the count values n+1 and n+3 represent "+1." When the BLPWM signals [1:0] represents 3, the time domains corresponding to the count values n+1, n+2, and n+3 represent "+1."

However, the table T1 is illustrated only as an example. Thus, "+1" under the column "Values of change of BLPWM [9:2]" may be allocated in a balanced manner differently.

FIG. 12 is another exemplary table T1-1 illustrating values of change of the time-divided BLPWM signals [9:2]. The table T1-1 in FIG. 12 includes "+1" at time domains different from those in the table T1 in FIG. 9.

Namely, in the table T1-1, the fractional part is represented differently. For example, when the BLPWM signal [1:0] represents 1, the time domain corresponding to the count value n represents "+1", and when the BLPWM signal [1:0] represents 2, the time domains corresponding to the count values n and n+2 represent "+1." In addition, when the BLPWM signal [1:0] represents 3, the time domains corresponding to the count values n, n+1, and n+2 represent "+1."

Figure 13:
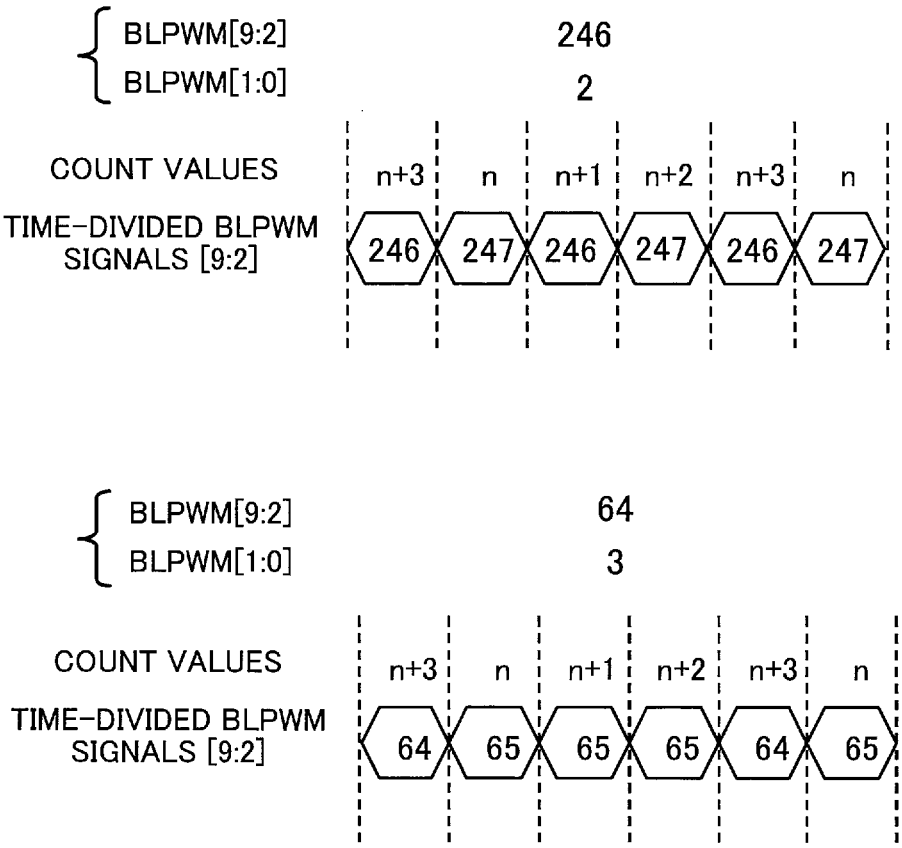
FIG. 13 illustrates time-divided BLPWM signals.

FIG. 13 illustrates time-divided BLPWM signals. FIG. 13 illustrates an example in which the BLPWM signal [9:2] represents 246 and the BLPWM signal [1:0] represents 2 in the table T1-1. FIG. 13 also illustrates an example in which the BLPWM signal [9:2] represents 64 and the BLPWM signal [1:0] represents 3.

When the BLPWM signal [9:2] represents 246 and the BLPWM signal [1:0] represents 2, the time domains corresponding to the count values n and n+2 represent "+1" and the time domains corresponding to the count values n+1 and n+3 represent "0" in the table T1-1.

Thus, regarding the time-divided BLPWM signals [9:2] in this example, 247 is located in the time domains corresponding to the count values n and n+2 and 246 is located in the time domains corresponding to the count values n+1 and n+3.

In addition, when the BLPWM signals [9:2] represents 64 and the BLPWM signal [1:0] represents 3, the time domains corresponding to the count values n, n+1, and n+2 represent "+1" and the time domain corresponding to the count value n+3 represents "0" in the table T1-1.

Thus, regarding the time-divided BLPWM signals [9:2] in this example, 65 (=64+1) is located in the time domains corresponding to the count values n, n+1, and n+2 and 64 (=64+0) is located in the time domain corresponding to the count value n+3.

FIG. 14 is another exemplary table T1-2 illustrating values of change of time-divided BLPWM signals [9:2]. In the table T1 in FIG. 9, only "+1" is used under the column "Values of change of BLPWM[9:2]." However, in the table T1-2 in FIG. 14, "+2" is also used in addition to "+1" under the column "Values of change of BLPWM[9:2]" to represent a fractional part.

If a fractional part is represented on the basis of the table T1-2, when the BLPWM signal [1:0] represents 1, the time domain corresponding to the count value n represents "+1" and when the BLPWM signal [1:0] represents 2, the time domains corresponding to the count values n and n+2 represent "+1." In addition, when the BLPWM signal [1:0] represents 3, the time domain corresponding to the count value n represents "+2" and the time domain corresponding to the count value n+2 represents "+1."

Figure 15:
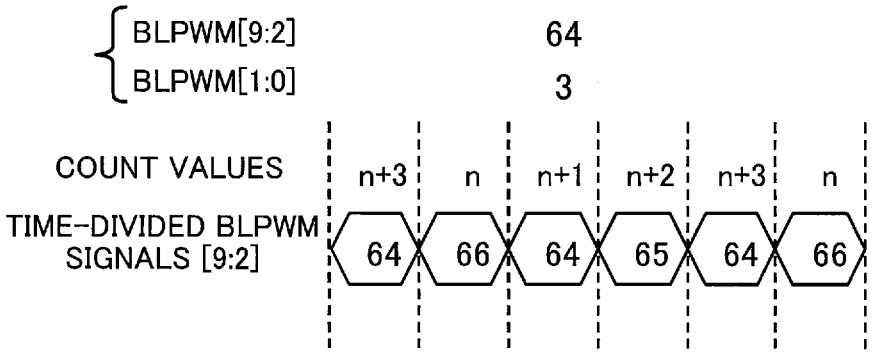
FIG. 15 illustrates time-divided BLPWM signals.

FIG. 15 illustrates time-divided BLPWM signals. FIG. 15 illustrates an example in which the BLPWM signal [9:2] represents 64 and the BLPWM signal [1:0] represents 3 in the table T1-2.

When the BLPWM signal [9:2] represent 64 and the BLPWM signal [1:0] represents 3, the time domain corresponding to the count value n represents "+2," the time domains corresponding to the count values n+1 and n+3 represent "0," and the time domain of the count value n+2 represents "+1" in the table T1-2.

Thus, regarding the time-divided BLPWM signals [9:2] in this example, 66 (=64+2) is located in the time domain corresponding to the count value n, 64 (=64+0) is located in the time domains corresponding to the count values n+1 and n+3, and 65 (=64+1) is located in the time domain corresponding to the count value n+2.

FIG. 16 is another exemplary table T1-3 illustrating values of change of time-divided BLPWM signals [9:2]. In the table T1 in FIG. 9, only "+1" is used under the column "Values of change of BLPWM[9:2]." However, in the table T1-3 in FIG. 16, "+2" and "−1" are also used in addition to "+1" under the column "Values of change of BLPWM[9:2]" to represent a fractional part.

If a fractional part is represented on the basis of the table T1-3, when the BLPWM signal [1:0] represents 1, the time domains corresponding to the count values n and n+2 represent "+1" and the time domain corresponding to the count value n+3 represents "−1." When the BLPWM signal [1:0] represents 2, the time domains corresponding to the count values n and n+2 represent "+1." In addition, when the BLPWM signal [1:0] represents 3, the time domain corresponding to the count value n represents "+2" and the time domain corresponding to the count value n+2 represents "+1."

Figure 17:
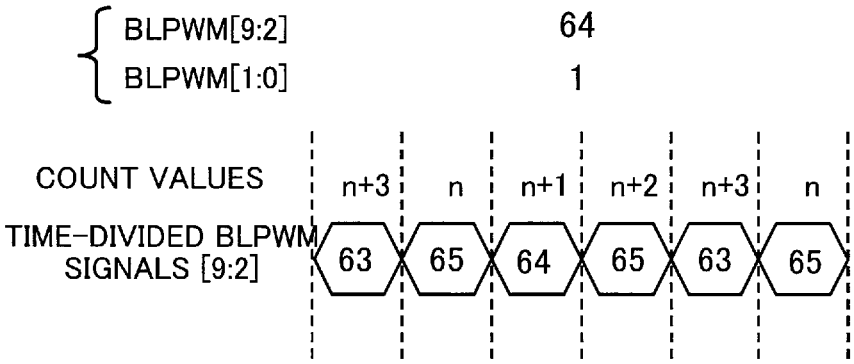
FIG. 17 illustrates time-divided BLPWM signals.

FIG. 17 illustrates time-divided BLPWM signals. FIG. 17 illustrates an example in which the BLPWM signal [9:2] represents 64 and the BLPWM signal [1:0] represents 1 in the table T1-3.

When the BLPWM signal [9:2] represents 64 and the BLPWM signal [1:0] represents 1, the time domains corresponding to the count values n and n+2 represent "+1," the time domain corresponding to the count value n+1 represents "0," and the time domain corresponding to the count value n+3 represents "−1" in the table T1-3.

Thus, regarding the time-divided BLPWM signals [9:2] in this example, 65 (=64+1) is located in the time domains corresponding to the count values n and n+2, (=64+0) is located in the time domain corresponding to the count value n+1, 63 (=64−1) is located in the time domain corresponding to the count value n+3. The above settings of values of change of the time-divided BLPWM signals [9:2] are merely examples. The values of change may be set on the basis of other variations.

Next, as another exemplary BLPWM time-division control, an example in which a 12-bit BLPWM signal is converted into 8-bit time-divided BLPWM signals will be described. The following description will be made assuming that each BLPWM signal is a 12-bit parallel signal and a value represented by the 12-bit BLPWM signal in frame N is 3163.

Hereinafter, BLPWM time-division control for converting a 12-bit BLPWM signal in such a frame into 8-bit BLPWM signals will be described.

In this example, the lower 4 bits of the 12 bits are dropped, which corresponds to a division by $2^4$ in a bit shift operation. In the case of frame N, 3163 is divided by $2^4$, and 197.6875 (=3163/16) is obtained. The result 197.6875 includes an integer part of 197 represented by 8 bits and a fractional part of 0.6875.

Thus, in the time domain in frame N, a time division operation is performed on 3163 represented by the 12-bit BLPWM signal to generate five 8-bit BLPWM signals 197 and eleven 8-bit BLPWM signals 198.

In this example, the average value of the 8-bit BLPWM signals is 197.6875 ((197×5+198×11)/16). The fractional part is represented by the five 8-bit time-divided BLPWM signals 197 and eleven 8-bit time-divided BLPWM signals 198.

FIG. 18 is an exemplary table T2 illustrating values of change of 8-bit time-divided BLPWM signals [11:4]. The table T2 includes columns for "BLPWM[3:0]," "Values of change of BLPWM[11:4]," and "Fractional part."

The column for "Values of change of BLPWM[11:4]" is divided into 16 time domains n to n+15, which correspond to count values of a counter.

In addition, in a single frame, this counter performs cyclic counting (n→n+1→ . . . →n+14→n+15→n→n+1→ and so on).

In the table T2, for example, BLPWM[3:0]=1 represents a fractional part of 0.0625. In such case, referring to the column "Values of change of BLPWM[11:4]," one of the count values n to n+15 represents "+1" and the other 15 count values represent "0."

In addition, for example, BLPWM[3:0]=11 represents a fractional part of 0.6875. In such case, referring to the column "Values of change of BLPWM[11:4]," 11 of the 16 count values n to n+15 represent "+1" and the other five count values "0."

Since the same concept is applied to cases where the BLPWM signal [3:0] represents any other value, redundant description of the table T2 will be avoided.

Figure 19:
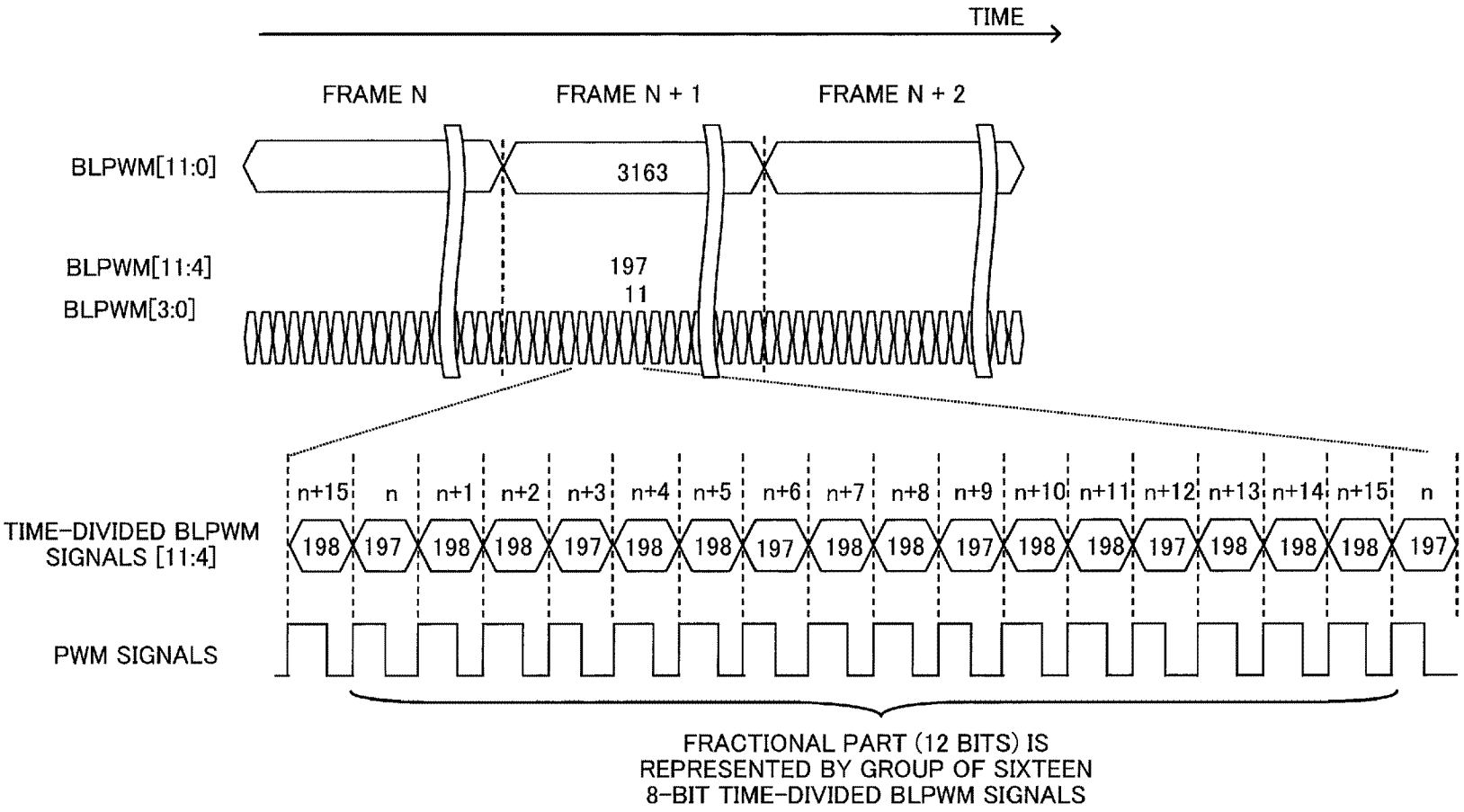
FIG. 19 illustrates exemplary BLPWM time-division control.

FIG. 19 illustrates exemplary BLPWM time-division control for converting each 12-bit BLPWM signal into 8-bit time-divided BLPWM signals. In frame N+1, a value represented by the 12-bit BLPWM signal [11:0] is 3163.

In frame N+1, since the average value is 197.6875 (=3163/16), the BLPWM signals [11:4] represent 197 and 198, and the BLPWM signal [3:0] represents 11 (corresponding to a fraction part of 0.6875).

In frame N+1, since the BLPWM signal [3:0] represents 11, the time domains corresponding to the count values n, n+3, n+6, n+9, and n+12 represent "0" and the time domains corresponding to the count values n+1, n+2, n+4, n+5, n+7, n+8, n+10, n+11, n+13, n+14, and n+15 represent "+1" in the table T2.

Thus, regarding the time-divided BLPWM signals [11:4] in frame N+1, the time domains corresponding to the count values n, n+3, n+6, n+9, and n+12 represent 197 (=197+0) and the time domains corresponding to the count values n+1, n+2, n+4, n+5, n+7, n+8, n+10, n+11, n+13, n+14, and n+15 represent 198 (=197+1).

Next, 1-bit PWM signals each having a pulse width corresponding to one of the values 197 and 198 are generated.

FIG. 20 is another exemplary table T2-1 illustrating values of change of 8-bit time-divided BLPWM signals [11:4]. In the table T2 in FIG. 18, only "+1" is used under the column "Values of change of BLPWM[11:4]." However, in the table T2-1 in FIG. 20, "+2" is also set in addition to "+1" under the column "Values of change of BLPWM[11:4]" to represent a fractional part. Since the table T2-1 is used in the same way as the above table, redundant description of the table T2-1 will be avoided.

Figure 21:
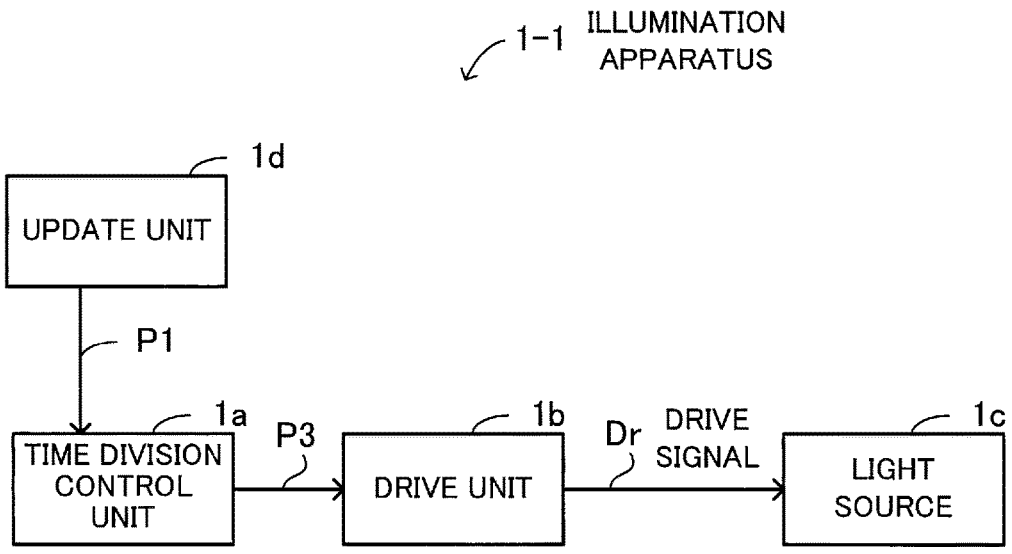
FIG. 21 illustrates an exemplary configuration of an illumination apparatus.

Next, an illumination apparatus 1-1 according to another embodiment will be described. FIG. 21 illustrates an exemplary configuration of the illumination apparatus 1-1. The illumination apparatus 1-1 includes a time division control unit 1*a*, a drive unit 1*b*, a light source 1*c*, and an update unit 1*d*. Description of the same components as those in FIG. 1 will be avoided.

The update unit 1*d* updates luminance gradation values represented by luminance control signals P1 of a first bit number. When a luminance control signal P3 changes from a first period to a second period, the update unit 1*d* updates a corresponding luminance gradation value.

Figure 22:
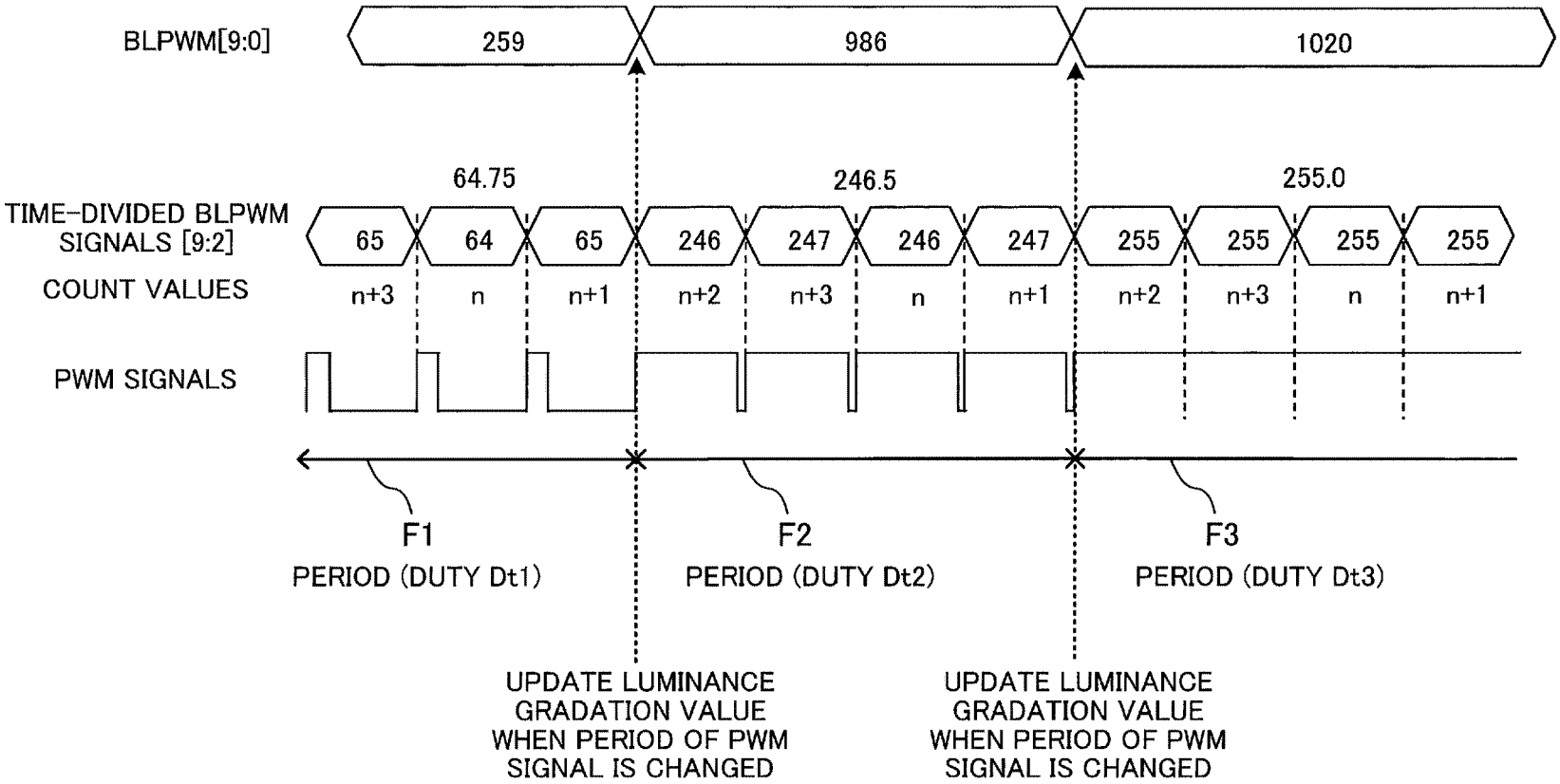
FIG. 22 illustrates update timing of BLPWM signals.

FIG. 22 illustrates update timing of BLPWM signals. In FIG. 22, the values represented by 10-bit BLPWM signals [9:0] are 259, 986, and 1020.

In this way, the luminance gradation values represented by the BLPWM signals [9:0] are updated. In addition, a BLPWM signal [9:0] is converted into time-divided BLPWM signals [9:2], and PWM signals are generated from the time-divided BLPWM signals [9:2]. When the period of a PWM signal is changed, the luminance gradation value of a corresponding BLPWM signal [9:2] is updated.

For example, when a PWM signal changes from a period of F1 (a duty Dt1) to a period of F2 (a duty Dt2), the luminance gradation value of the BLPWM signal [9:0] is updated from 259 to 986.

In addition, when a PWM signal changes from the period of F2 (the duty Dt2) to a period of F3 (a duty Dt3), the luminance gradation value of the BLPWM signal [9:0] is updated from 986 to 1020 (in reality, since a delay is caused by circuit processing, time lag is caused between when the period of the PWM signal changes and when the BLPWM signal [9:0] is updated. However, for ease of description, FIG. 22 illustrates an ideal state).

With such control, since the luminance gradation value corresponding to a PWM signal is updated without destroying one period constituting a certain duty of the PWM signal, flickering of the backlight luminance is reduced further.

Figure 23:
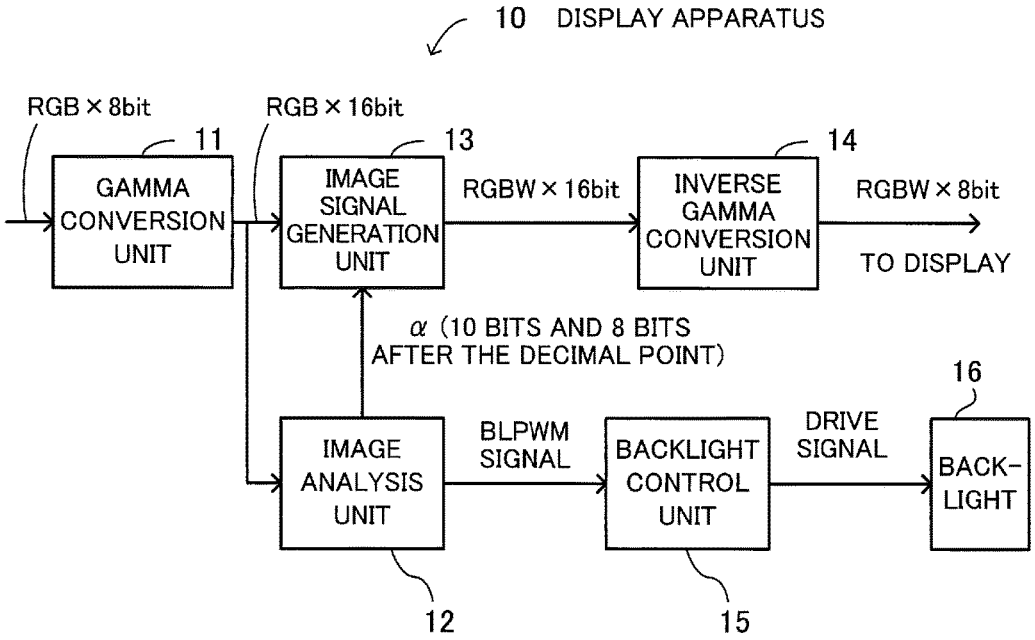
FIG. 23 illustrates an exemplary configuration of a display apparatus.

Next, an exemplary configuration of a display apparatus including functions of the illumination apparatus according to the present embodiment will be described with reference to FIG. 23. A display apparatus includes a gamma (γ) conversion unit 11, an image analysis unit 12, an image signal generation unit 13, an inverse-gamma (1/γ) conversion unit 14, a backlight control unit 15, and a backlight 16.

The backlight control unit 15 includes the functions of the time division control unit 1*a* and the drive unit 1*b* in FIG. 1 and the functions of the update unit 1*d* in FIG. 21. In addition, the light source 1*c* in FIG. 1 corresponds to the backlight 16.

The gamma conversion unit 11 performs gamma conversion on an RGB input signal in which each of R (a first subpixel), G (a second subpixel), and B (a third subpixel) is 8-bit data, for example. As a result, the gamma conversion unit 11 outputs an RGB signal (a first image signal) in which each of the first to third subpixels is 16-bit data.

When receiving the RGB signal from the gamma conversion unit 11, the image analysis unit 12 calculates a coefficient α of expansion (for example, 10 bits and 8 bits after the decimal point) and generates a BLPWM signal (a first luminance control signal) for controlling the luminance of the backlight 16.

On the basis of the coefficient α of expansion, the image signal generation unit 13 generates a W (a fourth subpixel) signal and outputs an RGBW signal (a second image signal) in which each of the first to fourth subpixels (R, G, B, and W) is 16-bit data, for example.

The inverse gamma conversion unit 14 performs inverse-gamma conversion on the RGBW signal output from the image signal generation unit 13 and outputs an RGBW signal in which each of the first to fourth subpixels (R, G, B, and W) is, for example, 8-bit data to a display.

The backlight control unit 15 controls the luminance of the backlight 16 on the basis of the BLPWM signal output from the image analysis unit 12.

Namely, the backlight control unit 15 performs a time-division operation on a value represented by the BLPWM signal of the first bit number for controlling the luminance of the backlight 16 to generate time-divided BLPWM signals (second luminance control signals) of a second bit number that is smaller than the first bit number. In addition, the backlight control unit 15 generates PWM signals (third luminance control signals) each having a pulse width that corresponds to one of the values represented by the time-divided BLPWM signals.

In addition, the backlight control unit 15 generates drive signals for causing the backlight 16 to emit light on the basis of the PWM signals and supplies the drive signals to the backlight 16.

Next, an exemplary hardware configuration of a display apparatus 100 will be described with reference to FIG. 24.

The display apparatus 100 includes a control unit 100*a*, a display driver integrated circuit (IC) 100*b*, an LED driver IC 100*c*, an input and output interface 100*d*, and a communication interface 100*e*, which are connected to each other via a bus 100*f* for exchange of signals. In addition, the display apparatus 100 includes an image display panel 200 and a planar light source 300.

The control unit 100*a* includes a central processing unit (CPU) 100*a*1 for comprehensively controlling the display apparatus 100. The control unit 100*a* further includes a random access memory (RAM) 100*a*2 and a read-only memory (ROM) 100*a*3 and is connected to a plurality of peripheral devices.

The RAM 100*a*2 is used as a main storage device of the display apparatus 100. At least a part of the operating system (OS) programs or the application programs executed by the CPU 100*a*1 is temporarily stored in the RAM 100*a*2. In addition, various kinds of data needed for processing by the CPU 100*a*1 is stored in the RAM 100*a*2.

The ROM 100*a*3 is a read-only semiconductor storage device in which OS programs, application programs, and fixed data that is not to be rewritten are stored. Instead of or in addition to the ROM 100*a*3, a semiconductor storage device such as a flash memory may be used as a secondary storage device.

The control unit 100*a* is connected to the display driver IC 100*b*, the LED driver IC 100*c*, the input and output interface 100*d*, and the communication interface 100*e* as peripheral devices, for example.

The display driver IC 100*b* is connected to the image display panel 200. When receiving an input signal, the display driver IC 100*b* performs predetermined processing and generates an output signal. By outputting a control signal based on the generated output signal to the image display panel 200, the display driver IC 100*b* causes the image display panel 200 to display an image.

The LED driver IC 100*c* is connected to each of the sidelight sources included in the planar light source 300. The LED driver IC 100*c* drives a light source on the basis of a light source control signal and controls the luminance of the planar light source 300.

The input and output interface 100*d* is connected to an input device that receives instructions from a user. For example, the input and output interface 100*d* is connected to input devices such as a keyboard, a mouse used as a pointing device, and a touch panel. The input and output interface 100*d* transmits a signal received from such an input device to the CPU 100*a*1 via the bus 100*f*.

The communication interface 100*e* is connected to a network 1000. The communication interface 100*e* exchanges data with other computers or communication devices via the network 1000.

Having such exemplary hardware configuration, the display apparatus 100 realizes processing functions of the present embodiment.

Figure 25:
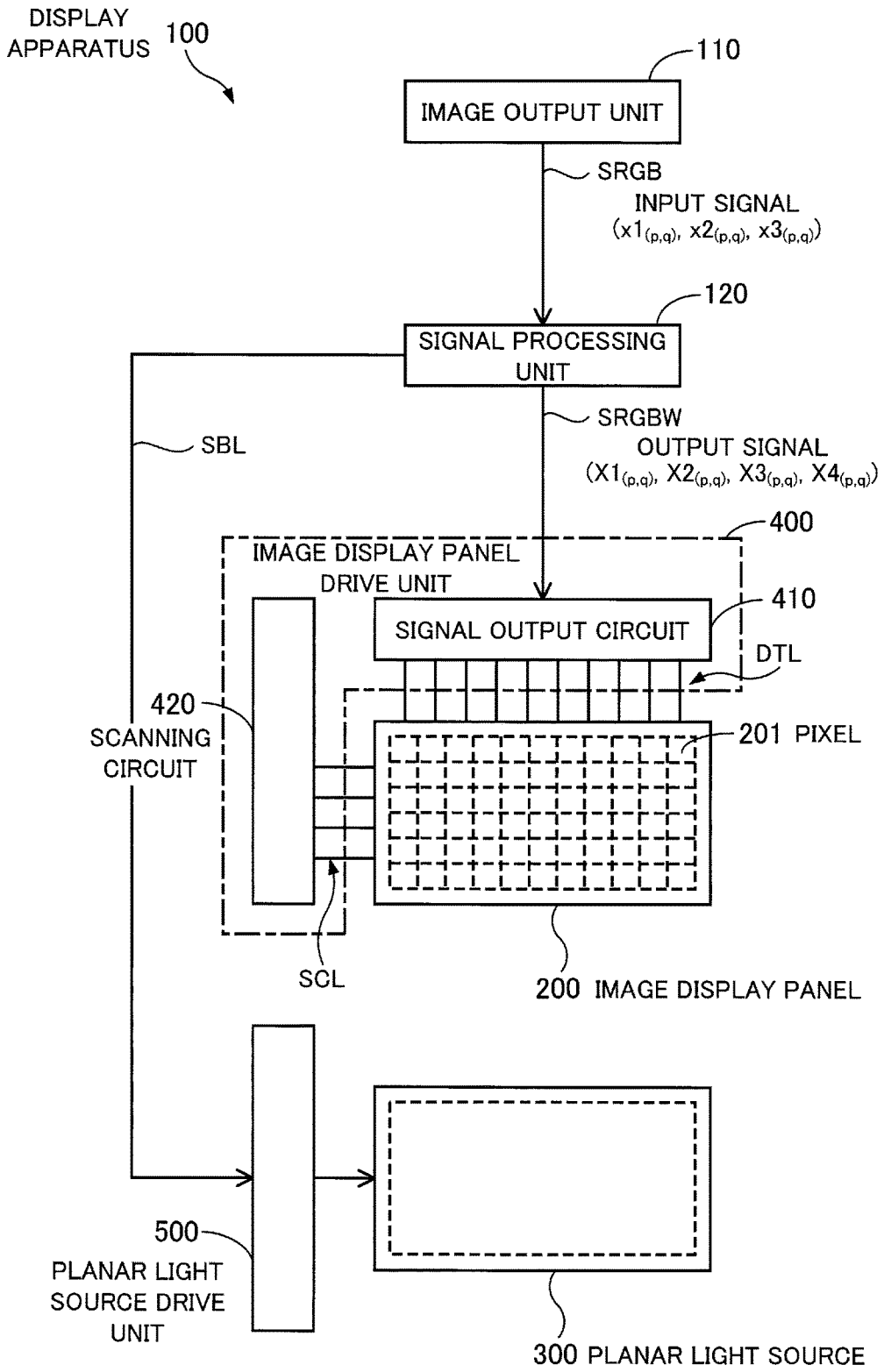
FIG. 25 illustrates an exemplary configuration of functions of the display apparatus.

Next, an exemplary configuration of functions of the display apparatus will be described with reference to FIG. 25.

The display apparatus 100 includes an image output unit 110 and a signal processing unit 120 and inputs an output signal SRGBW and a light source control signal SBL to an image display panel drive unit 400 and a planar light source drive unit 500, respectively. The image display panel drive unit 400 includes a signal output circuit 410 and a scanning circuit 420.

The image output unit 110 outputs an input signal SRGB (for example, the display-gradation bit number is 8) to the signal processing unit 120. The input signal SRGB includes input signal values x1(p,q), x2(p,q), and x3(p,q) for first to third primary colors, respectively. In the second embodiment, the first to third primary colors are red, green, and blue, respectively.

The signal processing unit 120 provides the image display panel drive unit 400 that drives the image display panel 200, which includes pixels 201 and the planar light source drive unit 500 that drives the planar light source 300 with the signals. The signal processing unit 120 determines an index for adjusting the luminance of pixels of the image display panel 200 (or an index for reducing the luminance of the planar light source 300) on the basis of the input signal SRGB. By calculating luminance information for each pixel of the planar light source 300 on the basis of the index and adjusting the output signal SRGBW (for example, the display-gradation bit number is 8), the signal processing unit 120 controls the image display by the planar light source 300. In addition to output signal values X1(p,q), X2(p,q), and X3(p,q) for the first to third subpixels, respectively, the output signal SRGBW includes an output signal value X4(p,q) for the fourth subpixel that expresses a fourth color. Herein, the fourth color is white.

Figure 24:
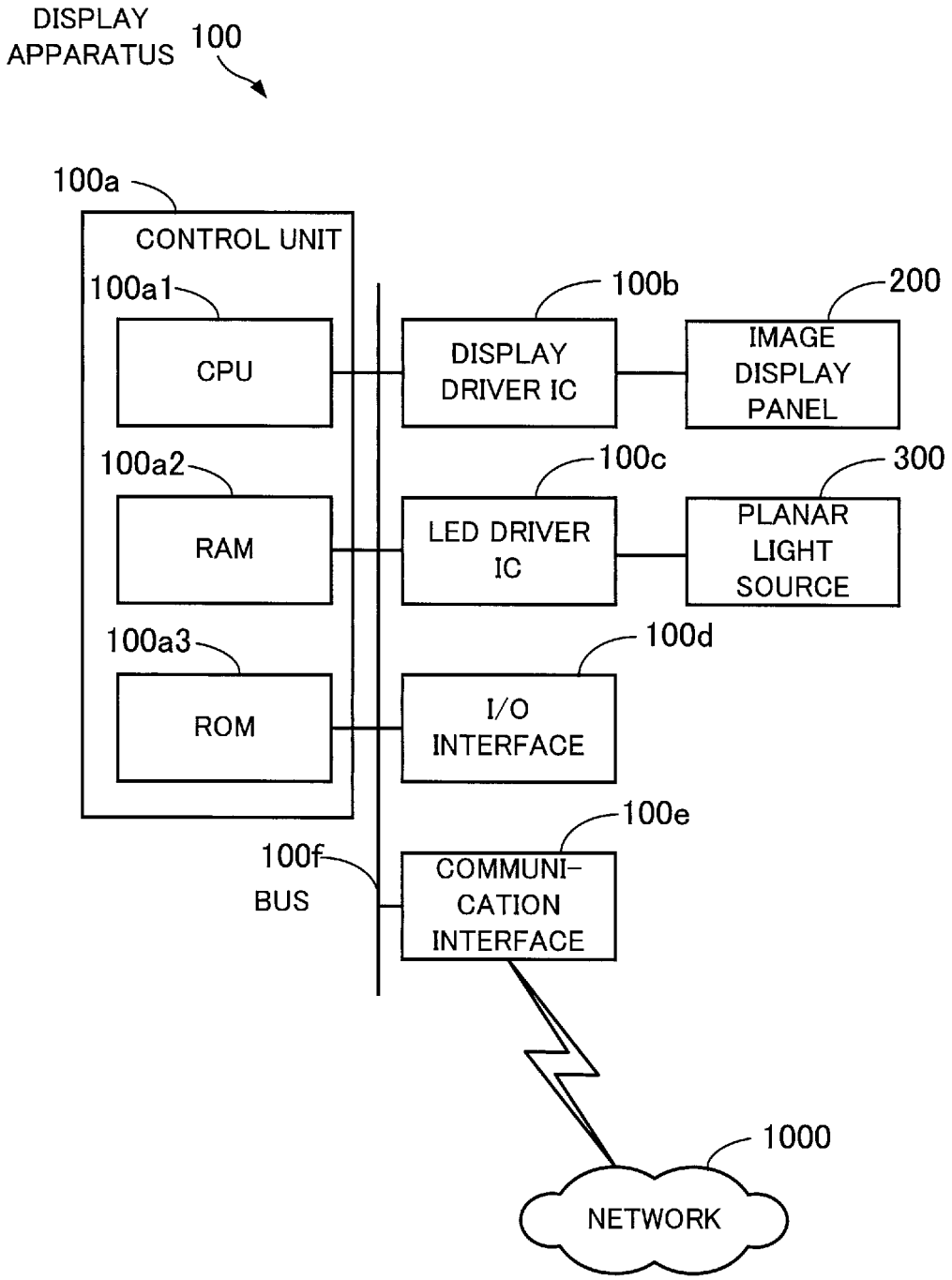
FIG. 24 illustrates an exemplary hardware configuration of a display apparatus.

Such processing operations of the signal processing unit 120 are realized by the display driver IC 100*b*, the CPU 100*a*1, or the like illustrated in FIG. 24.

To cause the display driver IC 100*b* to realize the processing operations, the input signal SRGB needs to be input to the display driver IC 100*b* via the CPU 100*a*1. In this way, the display driver IC 100*b* generates the output signal SRGBW and controls the image display panel 200. In addition, the display driver IC 100*b* generates the light source control signal SBL and transmits the generated light source control signal SBL to the LED driver IC 100*c* via the bus 100*f*.

To cause the CPU 100*a*1 to realize the processing operations, the CPU 100*a*1 needs to output the output signal SRGBW to the display driver IC 100*b*. In addition, the CPU 100*a*1 also needs to generate the light source control signal SBL and output the generated light source control signal SBL to the LED driver IC 100*c* via the bus 100*f*.

The processing functions of the above illumination apparatus or display apparatus may be realized by a computer. In such case, a program in which processing contents corresponding to the functions of the illumination apparatus or the display apparatus are written is provided. The processing functions are realized on the computer by causing the computer to execute the program. The program in which the processing contents are written may be recorded in a computer-readable recording medium.

Examples of the computer-readable recording medium include a magnetic storage device, an optical disc, a magneto-optical recording medium, and a semiconductor memory. Examples of the magnetic storage device include a hard disk drive (HDD), a flexible disk (FD), and a magnetic tape. Examples of the optical disc include a digital versatile disc (DVD), a DVD-RAM, a compact disc read-only memory (CD-ROM/RW), and a CD-R (Recordable)/RW (Rewritable). Examples of the magneto-optical recording medium include a magneto-optical disk (MO).

One way to distribute the program is to sell portable recording media such as DVDs or CD-ROMs in which the program is recorded. In addition, the program may be stored in a storage device of a server computer and forwarded to other computers from the server computer via a network.

For example, a computer that executes the program stores the program recorded in a portable recording medium or forwarded from the server computer in a storage device of the computer.

Next, the computer reads the program from its own storage device and executes processing in accordance with the program. The computer may directly read the program from the portable recording medium and perform processing in accordance with the program. In addition, each time the computer receives a program from the server computer connected via the network, the computer may execute processing in accordance with the received program.

At least a part of the above processing functions may be realized by an electric circuit such as a digital signal processor (DSP), an application specific integrated circuit (ASIC), or a programmable logic device (PLD).

According to one aspect, there is provided an illumination apparatus that includes: a light source; a time division control unit that performs a time division operation on a value represented by a first luminance control signal of a first bit number for controlling luminance of the light source to generate second luminance control signals each having a second bit number that is smaller than the first bit number, and generates third luminance control signals each having a pulse width that corresponds to one of the values represented by the second luminance control signals; and a drive unit that generates drive signals for causing the light source to emit light on the basis of the third luminance control signals and supplies the drive signals to the light source.

In the illumination apparatus, when the first bit number is K and the second bit number is L (<K), the time division control unit generates $2^{K-L}$ segments from a predetermined time domain of the first luminance control signal, divides a luminance gradation value represented by the first bit number by $2^{K-L}$, and allocates an integer value represented by the second bit number to each of the segments so that an average obtained by dividing the sum of values that are allocated to the segments by $2^{K-L}$ matches a value obtained as a result of the division.

Further, in the illumination apparatus, when the result of the division includes an integer part and a fractional part, the time division control unit adds a value of change corresponding to the fractional part to at least one of the integer values in the segments or subtracts the value of change from the at least one integer value, and allocates integer values represented by the second bit number, which are values that correspond to the integer part and at least one value obtained by adding or subtracting the value of change to or from the at least one integer value, to the segments.

Still further, in the illumination apparatus, when a plurality of values, which are obtained by adding the value of change corresponding to the fractional part to a plurality of integer values in the segments or subtracting the value of change from the plurality of integer values, exist, the time division control unit allocates the plurality of values in the segments in a balanced manner.

Still further, the illumination apparatus further includes: an update unit that updates a luminance gradation value represented by the first luminance control signal of the first bit number, wherein the update unit updates the luminance gradation value when one of the third luminance control signals changes from a first period to a second period.

In addition, according to one aspect, there is provided an illumination control method that includes: performing a time division operation on a value represented by a first luminance control signal of a first bit number for controlling luminance of a light source to generate second luminance control signals each having a second bit number that is smaller than the first bit number; generating third luminance control signals each having a pulse width that corresponds to one of the values represented by the second luminance control signals; generating drive signals for causing the light source to emit light on the basis of the third luminance control signals; and supplying the drive signals to the light source.

In addition, according to one aspect, there is provided a display apparatus that includes: an image analysis unit that calculates a coefficient of expansion from a first image including first to third subpixels and generates a first luminance control signal of a first bit number for controlling luminance of a light source; an image generation unit that generates a second image including the first to third subpixels and a fourth subpixel on the basis of the coefficient of expansion; and a light source control unit that performs a time division operation on a value represented by the first luminance control signal to generate second luminance control signals each having a second bit number that is smaller than the first bit number, generates third luminance control signals each having a pulse width that corresponds to one of the values represented by the second luminance control signals, generates drive signals for controlling the light source on the basis of the third luminance control signals, and supplies the drive signals to the light source.

In the display apparatus, when the first bit number is K and the second bit number is L (<K), the light source control unit generates $2^{K-L}$ segments from a predetermined time domain of the first luminance control signal, divides a luminance gradation value represented by the first bit number by $2^{K-L}$, and allocates an integer value represented by the second bit number to each of the segments so that an average obtained by dividing the sum of values that are allocated to the segments by $2^{K-L}$ matches a value obtained as a result of the division.

Further, in the display apparatus, when the result of the division includes an integer part and a fractional part, the light source control unit adds a value of change corresponding to the fractional part to at least one of the integer values in the segments or subtracts the value of change from the at least one integer value, and allocates integer values represented by the second bit number, which are values that correspond to the integer part and at least one value obtained by adding or subtracting the value of change to or from the at least one integer value, to the segments.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. An illumination apparatus comprising:

a light source;

a time division controller configured to perform a time division operation on a value represented by a first luminance control signal of a first bit number for controlling luminance of the light source to generate second luminance control signals each having a second bit number that is smaller than the first bit number, and generate third luminance control signals each having a pulse width that corresponds to one of the values represented by the second luminance control signals; and a driver configured to generate drive signals for causing the light source to emit light on the basis of the third luminance control signals and supply the drive signals to the light source, wherein, when the first bit number is K and the second bit number is L (<K), the time division controller generates $2^{K-L}$ segments from a predetermined time domain of the first luminance control signal, divides a luminance gradation value represented by the first bit number by $2^{K-L}$, and allocates an integer value represented by the second bit number to each of the segments so that an average obtained by dividing the sum of values that are allocated to the segments by $2^{K-L}$ matches a value obtained as a result of the division.

2. The illumination apparatus according to claim 1, wherein, when the result of the division includes an integer part and a fractional part, the time division controller adds a value of change corresponding to the fractional part to at least one of the integer values in the segments or subtracts the value of change from the at least one integer value, and allocates integer values represented by the second bit number, which are values that correspond to the integer part and at least one value obtained by adding or subtracting the value of change to or from the at least one integer value, to the segments.

3. The illumination apparatus according to claim 2, wherein, when a plurality of values, which are obtained by adding the value of change corresponding to the fractional part to a plurality of integer values in the segments or subtracting the value of change from the plurality of integer values, exist, the time division controller allocates the plurality of values in the segments in a balanced manner.

4. The illumination apparatus according to claim 1, further comprising:

an updater configured to update a luminance gradation value represented by the first luminance control signal of the first bit number, wherein the updater updates the luminance gradation value when one of the third luminance control signals changes from a first period to a second period.

5. An illumination control method comprising:

performing, by a time division controller, a time division operation on a value represented by a first luminance control signal of a first bit number for controlling luminance of a light source to generate second luminance control signals each having a second bit number that is smaller than the first bit number;

generating, by the time division controller, third luminance control signals each having a pulse width that corresponds to one of the values represented by the second luminance control signals;

generating, by a driver, drive signals for causing the light source to emit light on the basis of the third luminance control signals; and supplying, by the driver, the drive signals to the light source wherein, when the first bit number is K and the second bit number is L (<K), the time division controller generates $2^{K-L}$ segments from a predetermined time domain of the first luminance control signal, divides a luminance gradation value represented by the first bit number by $2^{K-L}$, and allocates an integer value represented by the second bit number to each of the segments so that an average obtained by dividing the sum of values that are allocated to the segments by $2^{K-L}$ matches a value obtained as a result of the division.

6. A display apparatus comprising:

an image analyzer configured to calculate a coefficient of expansion from a first image including first to third subpixels and generating a first luminance control signal of a first bit number for controlling luminance of a light source;

an image generator configured to generate a second image including the first to third subpixels and a fourth subpixel on the basis of the coefficient of expansion; and a light source controller configured to perform a time division operation on a value represented by the first luminance control signal to generate second luminance control signals each having a second bit number that is smaller than the first bit number, generate third luminance control signals each having a pulse width that corresponds to one of the values represented by the second luminance control signals, generate drive signals for controlling the light source on the basis of the third luminance control signals, and supply the drive signals to the light source wherein, when the first bit number is K and the second bit number is L (<K), the light source controller generates $2^{K-L}$ segments from a predetermined time domain of the first luminance control signal, divides a luminance gradation value represented by the first bit number by $2^{K-L}$, and allocates an integer value represented by the second bit number to each of the segments so that an average obtained by dividing the sum of values that are allocated to the segments by $2^{K-L}$ matches a value obtained as a result of the division.

7. The display apparatus according to claim 6, wherein, when the result of the division includes an integer part and a fractional part, the light source controller adds a value of change corresponding to the fractional part to at least one of the integer values in the segments or subtracts the value of change from the at least one integer value, and allocates integer values represented by the second bit number, which are values that correspond to the integer part and at least one value obtained by adding or subtracting the value of change to or from the at least one integer value, to the segments.

* * * * *